US010302355B2

(12) United States Patent
Butts

(10) Patent No.: US 10,302,355 B2
(45) Date of Patent: May 28, 2019

(54) SYSTEM AND METHOD FOR SEPARATING WIDE VARIATIONS IN METHANE AND NITROGEN

(71) Applicant: Butts Properties, Ltd., Midland, TX (US)

(72) Inventor: Rayburn C. Butts, Midland, TX (US)

(73) Assignee: Butts Properties, Ltd., Midland, TX (US)

( * ) Notice: Subject to any disclaimer, the term of this patent is extended or adjusted under 35 U.S.C. 154(b) by 0 days.

(21) Appl. No.: 15/730,995

(22) Filed: Oct. 12, 2017

(65) Prior Publication Data

US 2018/0031314 A1 Feb. 1, 2018

Related U.S. Application Data

(62) Division of application No. 14/806,184, filed on Jul. 22, 2015, now Pat. No. 9,816,752.

(51) Int. Cl.
*F25J 3/02* (2006.01)

(52) U.S. Cl.
CPC ..... *F25J 3/0233* (2013.01); *F25J 3/0209* (2013.01); *F25J 3/0238* (2013.01); *F25J 3/0257* (2013.01); *F25J 2200/04* (2013.01); *F25J 2205/04* (2013.01); *F25J 2230/32* (2013.01); *F25J 2235/60* (2013.01); *F25J 2280/02* (2013.01)

(58) Field of Classification Search
CPC ..... F25J 3/0233; F25J 3/0257; F25J 2200/04
See application file for complete search history.

(56) References Cited

U.S. PATENT DOCUMENTS

| | | | |
|---|---|---|---|
| 4,331,461 | A | 5/1982 | Karbosky et al. |
| 4,411,677 | A | 10/1983 | Pervier et al. |
| 4,451,275 | A | 5/1984 | Vines et al. |
| 4,474,591 | A | 10/1984 | Arand et al. |
| 4,547,209 | A | 10/1985 | Netzer |
| 4,609,390 | A | 9/1986 | Wilson |

(Continued)

FOREIGN PATENT DOCUMENTS

| | | |
|---|---|---|
| EP | 1065457 | 1/2001 |
| GB | 2208699 | 4/1989 |

(Continued)

OTHER PUBLICATIONS

Daniel J. Weidert et al.; Integrated Systems ? They Key to Unlocking Gas Processing, GPA Europe Conf., Sep. 1, 2011, pp. 1-10.

*Primary Examiner* — Tareq Alosh
(74) *Attorney, Agent, or Firm* — Ross Barnes LLP; Robin L. Barnes

(57) ABSTRACT

A system and method for removing nitrogen and producing a high pressure methane product stream from natural gas feed streams having wide variations in nitrogen and methane content are disclosed. Optional add-on systems may be incorporated into the nitrogen and methane separation to produce an NGL sales stream to reduce excess hydrocarbons in the nitrogen vent stream, or to recover helium. The system and method of the invention are particularly suitable for use with feed streams in excess of 50 MMSCFD and up to 300 MMSCFD and containing up to 100 ppm carbon dioxide. Typical power requirements for compressing the methane product stream to produce a suitably high pressure stream for sale are reduced according to the systems and methods of the invention.

17 Claims, 14 Drawing Sheets

(56) References Cited

U.S. PATENT DOCUMENTS

| | | | |
|---|---|---|---|
| 4,948,405 | A | 8/1990 | Thompson |
| 5,041,149 | A | 8/1991 | Handley |
| 5,051,120 | A | 9/1991 | Pahade et al. |
| 5,141,544 | A | 8/1992 | Butts |
| 5,257,505 | A | 11/1993 | Butts |
| 5,375,422 | A | 12/1994 | Butts |
| 6,116,051 | A | 9/2000 | Agrawal et al. |
| 6,205,813 | B1 | 3/2001 | Shah et al. |
| 7,520,143 | B2 | 4/2009 | Spilsbury |
| 8,522,574 | B2 | 9/2013 | Crawford et al. |
| 8,640,495 | B2 | 2/2014 | McNeil |
| 2004/0177646 | A1 | 9/2004 | Wilkinson et al. |
| 2004/0237581 | A1 | 12/2004 | Paradowski |
| 2010/0223950 | A1 | 9/2010 | Malsam |
| 2011/0289963 | A1 | 12/2011 | Price |
| 2012/0324943 | A1 | 12/2012 | Butts |
| 2014/0013797 | A1 | 1/2014 | Butts |
| 2015/0052938 | A1 | 2/2015 | Bauer et al. |

FOREIGN PATENT DOCUMENTS

| | | |
|---|---|---|
| RU | 2121637 | 11/1998 |
| WO | WO2009144423 | 12/2009 |

SYSTEM AND METHOD FOR SEPARATING WIDE VARIATIONS IN METHANE AND NITROGEN

CROSS REFERENCE TO RELATED APPLICATION

This application is a divisional of U.S. application Ser. No. 14/806,184 filed on Jul. 22, 2015.

BACKGROUND OF THE INVENTION

1. Field of the Invention

This invention relates to a system and method for separating nitrogen from methane and other components from natural gas streams. The invention also relates to a system and method for integrating natural gas liquids (NGL) extraction with nitrogen removal. The invention also relates to a system and method for removing excess hydrocarbons from a nitrogen vent stream and optionally recovering helium. The system and method of the invention are particularly suitable for use in recovering and processing feed streams typically in excess of 50 MMSCFD and up to 300 MMSCFD, depending on the concentration of nitrogen in the feed stream.

2. Description of Related Art

Nitrogen contamination is a frequently encountered problem in the production of natural gas from underground reservoirs. The nitrogen may be naturally occurring or may have been injected into the reservoir as part of an enhanced recovery operation. Transporting pipelines typically do not accept natural gas containing more than 4 mole percent inerts, such as nitrogen. As a result, the natural gas feed stream is generally processed to remove such inerts for sale and transportation of the processed natural gas.

One method for removing nitrogen from natural gas is to process the nitrogen and methane containing stream through a Nitrogen Rejection Unit or NRU. The NRU may be comprised of two cryogenic fractionating columns, such as that described in U.S. Pat. Nos. 4,451,275 and 4,609,390. These two column systems have the advantage of achieving high nitrogen purity in the nitrogen vent stream, but require higher capital expenditures for additional plant equipment, including the second column, and may require higher operating expenditures for refrigeration horsepower and for compression horsepower for the resulting methane stream.

The NRU may also be comprised of a single fractionating column, such as that described in U.S. Pat. Nos. 5,141,544, 5,257,505, and 5,375,422. These single column systems have the advantage of reduced capital expenditures on equipment, including elimination of the second column, and reduced operating expenditures because no external refrigeration equipment is necessary. In addition to capital and operating expenditures, many prior NRU systems have limitations associated with processing NRU feed streams containing high concentrations of carbon dioxide. Nitrogen rejection processes involve cryogenic temperatures, which may result in carbon dioxide freezing in certain nodes of the process causing blockage of process flow and process disruption. Carbon dioxide is typically removed by conventional methods from the NRU feed stream, to a maximum of approximately 35 parts per million (ppm) carbon dioxide, to avoid these issues.

Another example is found in UK Patent Application GB 2,208,699. The '699 application cools the feed stream by cross-exchange with the bottom liquid in the second column to provide part of the second column reboiler duty prior to feeding the top of the first column, effectively providing reflux to the first column. The '699 application also links the first column and second column by cooling the overhead stream from the first column by cross-exchange with bottom liquid in the second column to provide part of the reboiler duty for the second column. This concept is commonly referred to as a "heat pump" configuration. Since there is by definition a match of heat requirements or duties for the two different applications, variations in each duty requirement is limited. This limitation translates into a limited range of inlet nitrogen permissible into this style of NRU of approximately a 6-12% range on either side of the design point. If the incoming nitrogen content is outside of the design range then one of the connected heat exchangers has an insufficient amount of heat and the other connected exchanger is short of the required duty requirement. The result is either the amount of nitrogen remaining in the sales gas stream is too high to meet specifications or the amount of methane vented into the atmosphere with the rejected nitrogen is higher than the desired amount, resulting in excess green house gas emissions. In addition having a colder feed to the first column reduces the $CO_2$ tolerance for the systems, as stated in the '699 patent that $CO_2$ must be removed prior to processing. Having a warmer feed to the second column increases the duty required for the reflux in the second tower. Additionally, by linking the first column streams to the reboiler duty of the second column, and since the system of the '699 patent is not as tolerant of wide variations in nitrogen content in the feed stream, the '699 patent would have much higher power requirements for increased nitrogen levels. The '699 patent, like many prior art systems, also links the duties of the second column condenser and reboiler by using an open heat pump cycle where a portion of the bottoms liquid stream is used to provide the reflux duty to several intermediate condensers and an overhead condenser within the second column. Linking these duties decreases costs of the column, but also significantly decreases flexibility in handling higher nitrogen concentrations than original system design.

SUMMARY OF THE INVENTION

The system and method disclosed herein facilitate the economically efficient removal of nitrogen from methane. The system and method are particularly suitable for feed gas flow rates in excess of 50 MMSCFD and are capable of processing feed gas flow rates of up to around 300 MMSCFD, depending on the concentration of nitrogen in the feed stream. The system and method are also capable of processing feed gas containing concentrations of carbon dioxide up to approximately 100 ppm for typical nitrogen levels between 5-50%.

According to one preferred embodiment of the invention, a system and method are disclosed for processing a feed gas stream containing primarily nitrogen and methane through two fractionating columns to produce a processed natural gas stream suitable for sale to a transporting pipeline. The first column node is designed to remove methane and heavier hydrocarbon components from nitrogen, while the second column node is designed to remove nitrogen from the remaining methane. The overhead stream from the first column node feeds the second column node. The NRU feed gas which is the first column node overhead stream is not cooled to traditional targeted temperatures of −200 to −245 degrees F. The bottoms streams from the first and second fractionating columns are at varying pressures after further processing and are separately fed to a series of compressors to achieve a processed gas product stream of sufficient pressure for sale, typically at least 615 psia. The higher temperatures in the feeds to the fractionating columns allows the bulk of the methane to be separated from the NRU feed stream while reducing the overall compression required for the process by up to 40% when compared to traditional NRU processes. Additionally, the first column streams are not tied to the reboiler duty of the second column, which allows greater control over the temperature of the feed stream to the first column and the feed stream to the second column (the first overhead stream). This allows the system and method of the invention to feed the first column at a warmer temperature than prior art systems, which increases $CO_2$ tolerance in the feed stream. It also allows the feed to the second column to be colder, through cross-exchange with colder process streams rather than being limited by the temperature of the liquid in the bottom of the second column in prior art systems where the first column overhead stream provides part of the second column reboiler duty. Having a colder second column feed reduces the reflux duty in the second column.

According to another embodiment of the invention, a system and method is disclosed for NGL extraction integrated into the two columns NRU process downstream from the first column node. In traditional nitrogen separation systems, the separation of NGL components is more difficult in streams containing more than 5% nitrogen because nitrogen has a stripping effect, absorbing ethane and heavier components. According to this embodiment of the invention, the bulk methane and heavier components are removed from the nitrogen in the first column, allowing the bottoms stream containing less than 4% nitrogen, to be further processed for extraction of NGL. In addition, incoming hydrocarbons known as "heavy" hydrocarbons are concentrated in this bulk removal step making this stream ideally suited for the efficient removal of such components as may be required to meet downstream natural gas pipeline specifications.

According to another preferred embodiment, a reboiler for a first column nitrogen concentrator is external to the first column and a portion of the system feed stream is cooled through heat exchange with the first column bottoms stream in the reboiler. An external reboiler allows for flexibility into the feed stage location (either a higher tray or lower tray) stage into the first column. According to another preferred embodiment, the duties of the second column condenser and second column reboiler are independent of each other and not linked, which increases the range of operation for the system over a wide variety of inlet nitrogen concentrations, which would not be possible if these duties were linked. According to another preferred embodiment, a third column is provided to remove excess methane from a nitrogen vent stream prior to venting to comply with an ultra low methane content in the vent stream. According to another preferred embodiment, the third column may also be used to recover helium.

There are several advantages to the system and method disclosed herein not previously achievable by those of ordinary skill in the art using existing technologies. These advantages include, for example, an ability to process higher flow rate NRU feed streams from around 50 MMSCFD up to near 300 MMSCFD, NRU feed streams containing up to 100 ppm carbon dioxide, reduction in overall compression requirements, and integration of NGL extraction. Although the present system and method has the disadvantage of higher capital costs associated with additional equipment, compared to prior single column NRU processes, the costs of such are sufficiently offset by the savings in operating expenses, such as those from the reduced compression requirements, and the ability to efficiently produce a suitable processed natural gas stream and valuable NGL stream.

It will be appreciated by those of ordinary skill in the art upon reading this disclosure that references to separation of nitrogen and methane used herein refer to processing NRU feed gas to produce various multi-component product streams containing large amounts of the particular desired component, but not pure streams of any particular component. One of those product streams is a nitrogen vent stream, which is primarily comprised of nitrogen but may have small amounts of other components, such as methane and ethane. Another product stream is a processed gas stream, which is primarily comprised of methane but may have small amounts of other components, such as nitrogen, ethane, and propane. A third optional product stream, according to one embodiment of the invention, is an NGL product stream, which is primarily comprised of ethane, propane, and butane but may contain amounts of other components, such as hexane and pentane.

It will also be appreciated by those of ordinary skill in the art upon reading this disclosure that additional processing sections for removing carbon dioxide, water vapor, and possibly other components or contaminants that are present in the NRU feed stream, can also be included in the system and method of the invention, depending upon factors such as, for example, the origin and intended disposition of the product streams and the amounts of such other gases, impurities or contaminants as are present in the NRU feed stream.

BRIEF DESCRIPTION OF THE DRAWINGS

The system and method of the invention are further described and explained in relation to the following drawings wherein.

DESCRIPTION OF THE PREFERRED EMBODIMENTS

Figure 1:
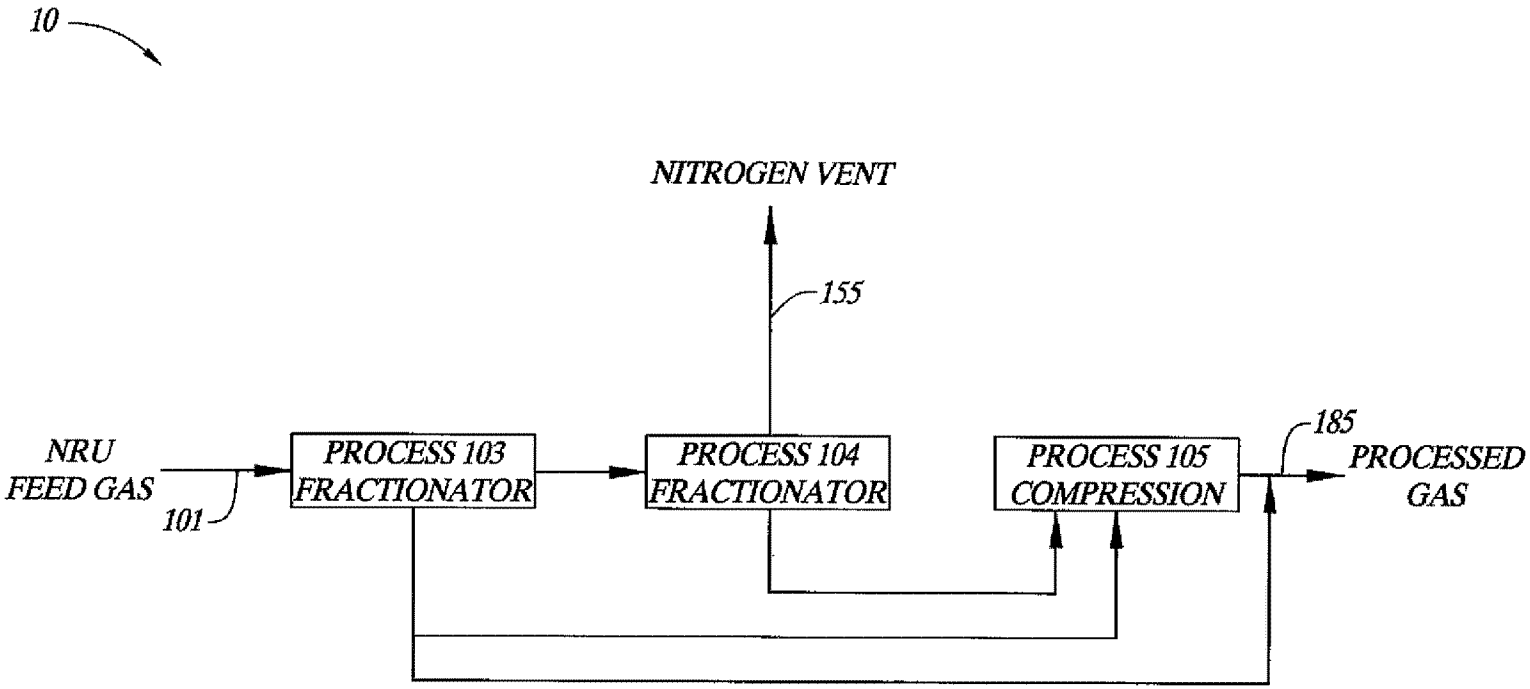
FIG. 1 is a simplified process flow diagram illustrating principal Processing Stages of one preferred embodiment of a system and method for separating nitrogen and methane.

Referring to FIGS. 1 and 1A-1C, System 10 for separating nitrogen from methane according to one preferred embodiment of the invention is depicted. System 10 includes Processing Stages 103, 104, and 105 for processing NRU feed gas stream 101 to produce a nitrogen vent stream 155 and a processed gas stream 185. Processing Stage 103 includes a first fractionating column, the overhead stream 121 from which serves as the feed for Processing Stage 104, which includes a second fractionating column. The overhead stream from the Processing Stage 104 is a nitrogen vent stream 155. The bottoms streams from Processing Stages 103 and 104 feed a series of compressors in Processing Stage 105 to produce processed gas 185 of sufficient pressure and methane composition to be suitable for sale.

Where present, it is generally preferable for purposes of the present invention to remove as much of the water vapor and other contaminants from the NRU feed gas 101 or 201 as is reasonably possible prior to separating the nitrogen and methane. It may also be desirable to remove excess amounts of carbon dioxide prior to separating the nitrogen and methane; however, the method and system are capable of processing NRU feed streams containing up to approximately 100 ppm carbon dioxide without encountering the freeze-out problems associated with prior systems and methods. Methods for removing water vapor, carbon dioxide, and other contaminants are generally known to those of ordinary skill in the art and are not described herein.

Figure 1A:
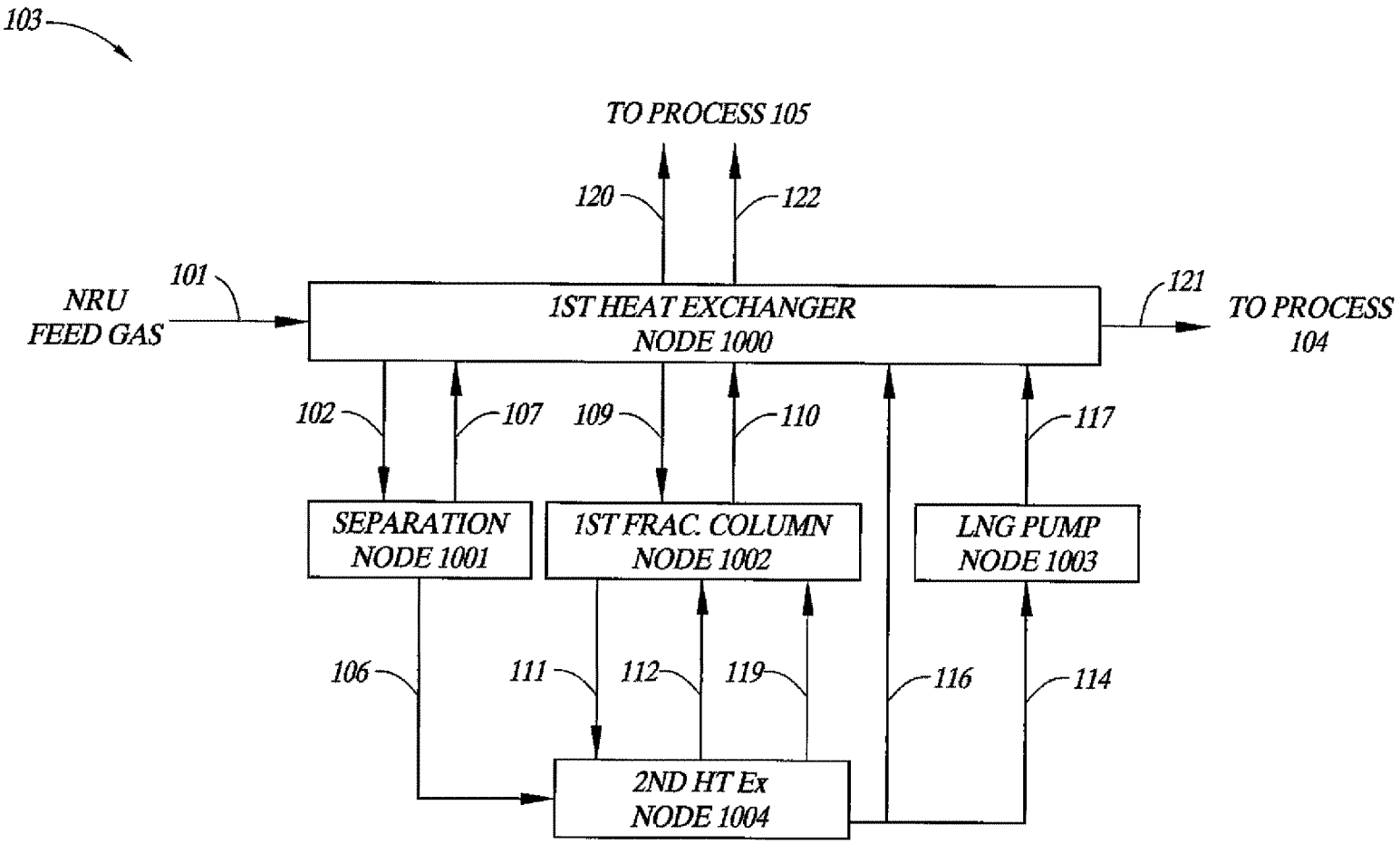
FIG. 1A is a more detailed process flow diagram illustrating a preferred embodiment of a methane and heavy hydrocarbon separation portion of the simplified process flow diagram of FIG. 1.
Figure 1B:
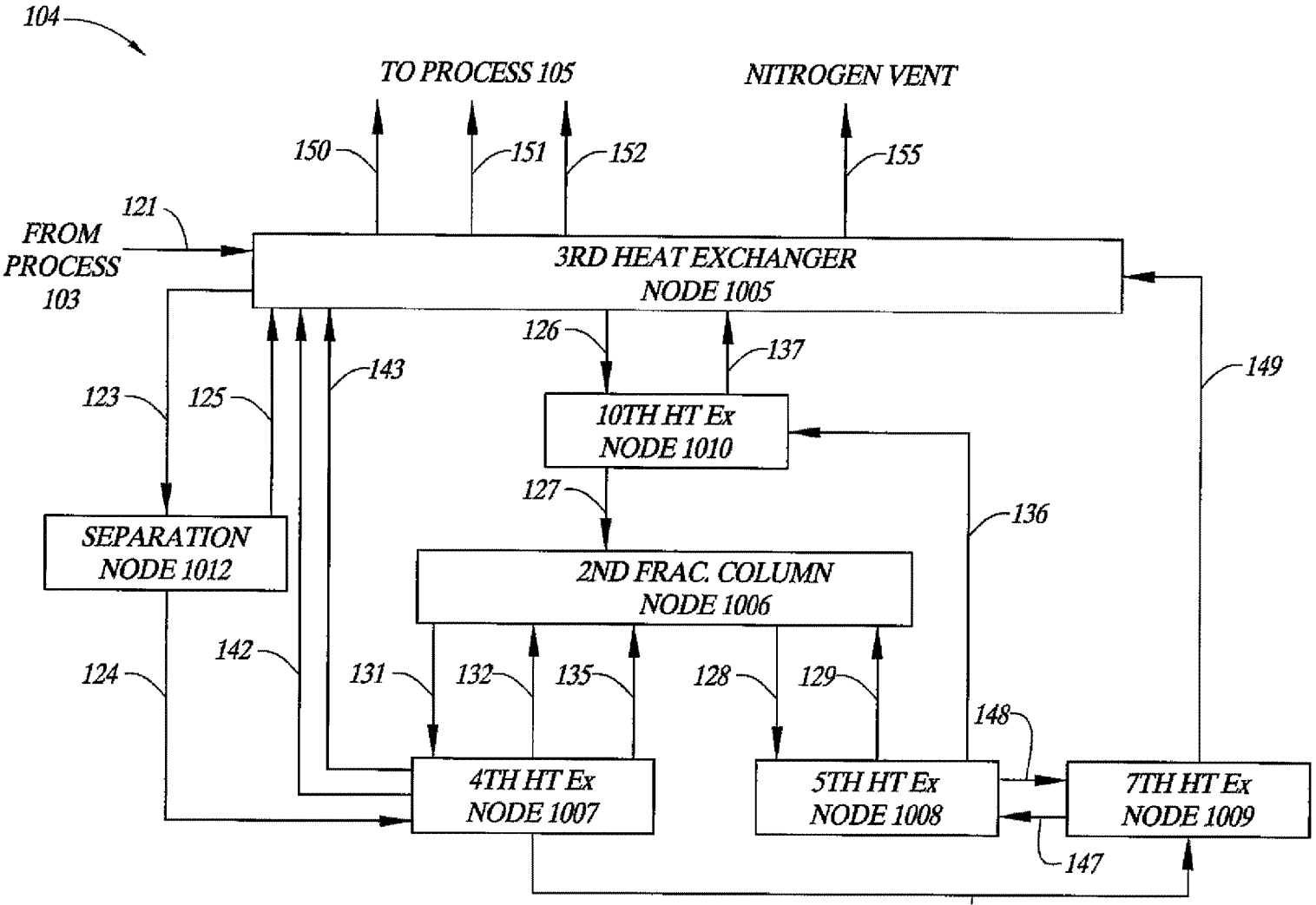
FIG. 1B is a more detailed process flow diagram illustrating a preferred embodiment of a nitrogen separation from methane portion of the simplified process flow diagram of FIG. 1.
Figure 1C:
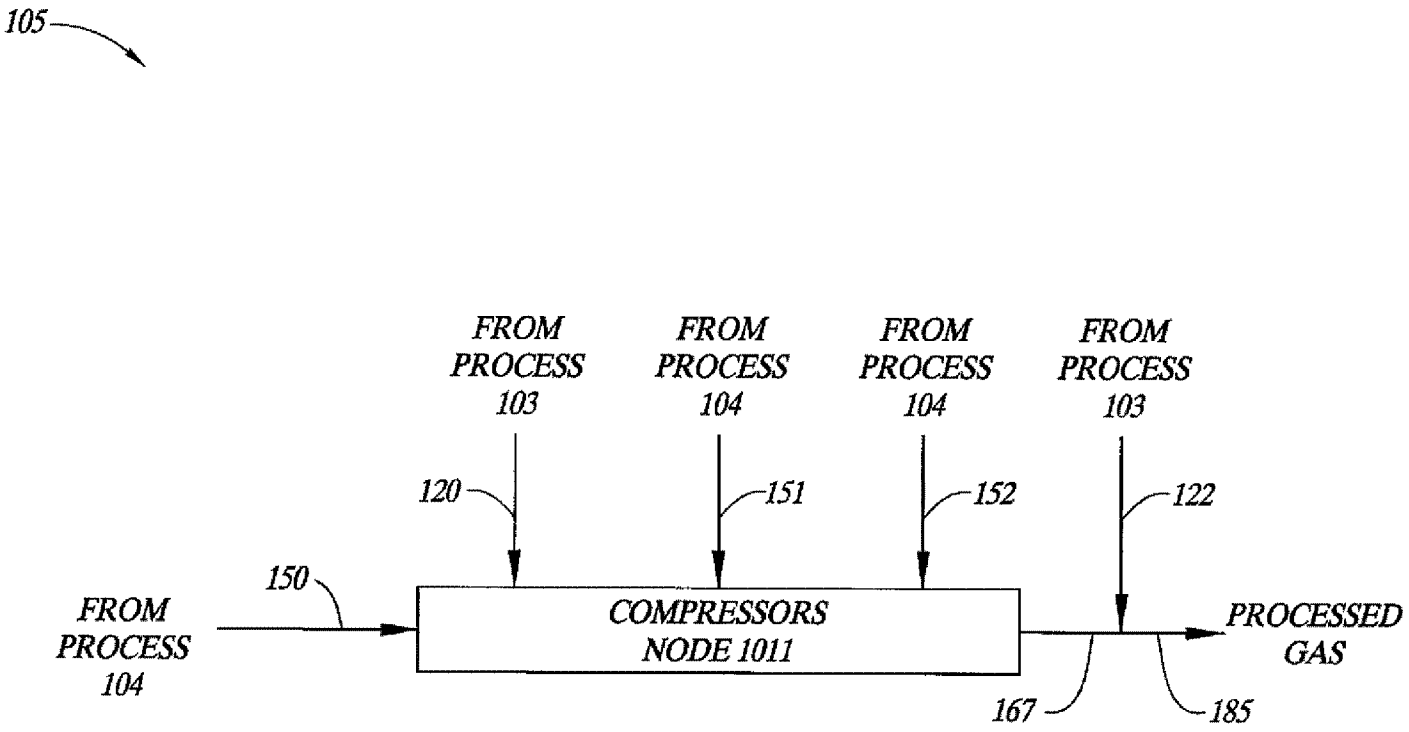
FIG. 1C is a more detailed process flow diagram illustrating a preferred embodiment of a compression portion of the simplified process flow diagram of FIG. 1.

Preferred embodiments of Processing Stages 103, 104, and 105 of System 10 are depicted in greater detail in FIGS. 1A-1C. Referring to FIG. 1A, a 250 MMSCFD NRU feed stream 101 containing approximately 25% nitrogen and 70% methane at 115° F. and 865 psia passes through 1$^{st}$ Heat Exchanger Node 1000, which preferably comprises a plate-fin heat exchanger. The feed stream emerges from the heat exchanger and enters into Separation Node 1001 (a splitter in this example) having been cooled to −75° F. as stream 102. This cooling is the result of heat exchange with other process streams 107, 110, 116, and 117, as discussed below. The cooled stream 102 is then split into two independent streams 107 and 106. Stream 107 reenters the Node 1000 where it is further cooled to approximately −185° F. The cooling is accomplished again by cross-exchange with streams 110, 116, and 117. This cooled feed stream passes through an expansion valve and is cooled slightly and having a reduction in pressure of around 315 psia (to 550 psia) before entering as the feed stream 109 for the 1$^{st}$ Fractionating Column Node 1002. Stream 109 operates at approximately −185° F. and is preferably fed into Column Node 1002 on tray 1 at the top of the column. Column Node 1002 operates at approximately −156° F. on top to −116° F. at bottom and 565 psia, which is at a higher temperature and pressure than targeted values in traditional double-column NRU systems.

Stream 111 from the bottom of the 1$^{st}$ Fractionating Column Node 1002 is preferably directed to 2$^{nd}$ Heat Exchange Node 1004 that receives heat (Q-2 see Table 3 below) from the second stream exiting the Separation Node 1001 as stream 106. 2$^{nd}$ Heat Exchanger Node 1004 is preferably an external shell and tube type heat exchanger that serves as a reboiler for 1$^{st}$ Fractionating Column Node 1002. Stream 111 is at approximately −123° F. and 570 psia and contains approximately 2% nitrogen and 90% methane. Bottoms stream 111 enters 2$^{nd}$ Heat Exchange Node 1004 to produce vapor stream 112 (partially vaporized) and liquid stream 113 internal to Node 1004. Partially vaporized stream 112 at approximately −116° F. is returned to the 1$^{st}$ Fractionating Column Node 1002 as the ascending stripping vapor that strips nitrogen from the hydrocarbon flowing downward through the column. The liquid stream 113 is split into two streams 114 and 116. The first liquid split stream is stream 114. Under the parameters of the specific example and operating conditions described herein, this splitter is set so that 60% of the liquid stream 113 is directed to stream 114. Stream 114 is pumped by an optional LNG pump (Q-1) from a pressure of approximately 570 psia to near 1065 psia (stream 117) before entering 1$^{st}$ Heat Exchanger Node 1000. The benefit of this pump is to minimize the overall compression horsepower required in Node 1011. Stream 117 enters the Heat Exchange Node 1000 and exits as stream 122 at a temperature of near 110° F. and a pressure of approximately 1060 psia. The second liquid split stream is routed to a pressure reducing control valve and exits as stream 116 where it is routed to the 1$^{st}$ Heat Exchanger Node 1000 and exits as stream 120 at a temperature of near 75° F. and a pressure of 120 psia. One primary benefit of this design configuration is that all re-vaporized product in stream 120 can be routed directly to sales gas pipeline without typical sales gas compression (see FIG. 1C). The result is a dramatic reduction in the overall compression requirement as compared to other typical processes.

Stream 119 is the continuation of stream 106 and exits the 2$^{nd}$ Heat Exchanger Node 1004 at a reduced temperature of approximately −118° F. Here it is expanded across another JT valve and enters the Fractionation Column Node 1002 with a temperature of approximately −127° F. and at a strategic point lower in the column than the feed stream 109. Having 2$^{nd}$ Heat Exchanger Node 1004 external to the 1$^{st}$ Fractionating Column Node 1002 provides greater flexibility in the feed stage location (either a higher tray or lower tray) for feed stream 119. Most preferably, stream 119 is fed into 1$^{st}$ Fractionating Column Node 1002 nominally to tray 5, instead of around the bottom tray as would be typical of prior art systems and methods where the reboiler is internal to the column. This feed location is based on the temperature differential between the 1st Fractionating Column Node feed streams 109 and 119, which is typically about 60° F. In the simulation example herein, the differential is around 60° F. If the differential were smaller, around 5° F. to 10° F., then stream 119 would be fed into Column Node 1002 at around tray 3. The higher the temperature differential, the greater the benefit in feeding stream 119 at a lower tray. Additionally, the feed location for stream 119 generally is fed to a lower tray when the concentration of nitrogen in the system feed stream 101 increases. The vapor from the warmer stream 119 feed acts as a heating medium within Column Node 1002, providing for a secondary reboil within the column. This secondary reboil improves the overall efficiency of system 10, at least in part by reducing the amount of gas fed to Processing Stage 104 by around 10%, which ultimately reduces the compression power requirements for Processing Stage 105. The improved efficiency associated with splitting the feed stream into two streams to 1st Fractionating Column Node 1002, and passing one of those streams through an external reboiler in the Second Heat Exchange Node 1004, so that it enters the column (as stream 119) warmer than the other 1st column feed (stream 109), is not found in typical prior art systems where there is a single feed into the first stage fractionation column having an internal reboiler.

In this example, the NRU feed stream 101 contains no carbon dioxide. However, System 10 is capable of processing NRU feed streams containing up to 100 ppm carbon dioxide. The physical separation characteristics of carbon dioxide are similar to an average of ethane and propane. With these parameters, the carbon dioxide would be separated in the 1st Fractionating Column Node 1002 into the bottoms stream, along with methane, ethane, propane, and other hydrocarbons. The bottoms stream 111 (and subsequent process streams) of the First Fractionating Column Node 1000 does not feed the 2nd Fractionating Column Node 1006 so the carbon dioxide containing stream does not enter the cryogenic section of the process (Processing Stage 104). This eliminates freeze-out problems with prior systems and increases the carbon dioxide tolerance of System 10 according to the invention from approximately 10 ppm in prior systems up to 100 ppm.

Overhead stream 110 containing approximately 38% nitrogen and 60% methane at −156° F., exits the 1st Fractionating Column Node 1002. It is not necessary to use a reflux stream in the 1st Fractionating Column Node 1002 according to the invention and overhead stream 110 is preferably not condensed through exchange Node 1000 prior to entering 3rd Heat Exchange Node 1005 (as stream 121). The operating parameters for the fractionation column in Node 1002 allow sufficient separation of nitrogen and methane without reflux; however, a reflux stream and related equipment could be used with the 1st Column of System 10 if desired. Overhead stream 110 is warmed to approximately 110° F. and exits Node 1000 as stream 121 prior to passing through the 3rd Heat Exchange Node 1005 shown on FIG. 1B. Stream 121 then passes through 3rd Heat Exchange Node 1005, which preferably comprises a plate-fin and at least one shell and tube type heat exchanger and exits at approximately −210° F., where it is split into two streams with stream 123 entering back into the 3nd Heat Exchanger Node 1005 and stream 124 entering into the 4th Heat Exchanger Node 1007. The first of these streams is recycled back through 3nd Heat Exchange Node 1005 and then enters a JT valve (Node 1010) reducing the pressure to near 350 psia with a temperature of near −211° F. prior to feeding 2nd Fractionating Column Node 1006 as stream 127. This cooling is the result of heat exchange with other process streams 142, 143, 136, and 149. The primary JT valve is capable of cooling by the well-known Joule-Thomson effect, but in post-start up, steady state operation the valve provides less actual thermal cooling, but does provide the necessary pressure reduction for stream 127, which feeds the 2nd Fractionating Column Node 1006 at −211° F. and 350 psia. The second of these streams, stream 124, passes through 4th Heat Exchange Node 1007, which is the external reboiler for the 2nd Fractionating Column Node 1006, emerging as stream 135, which also feeds the 2nd Fractionating Column Node 1006. The 4th Heat Exchange Node 1007 preferably is comprised of a shell and tube style heat exchanger that acts as a reboiler for Column Node 1006. The reboiler Node 1007 for Column Node 1006 is mounted external to the tower and is of conventional design. One advantage of this design is that the placement of this heat exchanger not only provides the necessary heat or energy for the Column Node 1006 "reboiler" but that it also reduces the temperature differential across the plate-fin exchanger in Node 1005.

By routing the 1st Column overhead stream 121 through the 3rd Heat Exchanger Node 1005 and then splitting the feed stream into stream 124 and 127 prior to feeding the 2nd Column Node 1006, System 10 is able to achieve much colder temperatures for the primary feed (Stream 127) to Column Node 1006 compared to prior art systems. Stream 124 is then utilized to provide the heat source for the 2nd Column Node 1006 bottom reboiler (4th Heat Exchanger Node 1007). The exiting heat medium stream from Node 1007 (stream 135) then enters Column Node 1006. This stream is inherently warmer than the opposing column feed stream 127. Stream 127 normally operates at a temperature of −211° F. and stream 135 normally operates at a temperature of −182° F. This differential on temperatures allows for optimization of the Column Node 1006 operation by strategically placing the entrance of these two streams separate and apart. Stream 127 would enter the column at a higher feed point than would stream 135. Prior art systems use the first column overhead stream to provide reboiler duty to the second column prior to feeding the second column, which limits the cooling of the first overhead stream prior to feeding the second column to the temperature of the liquid in the bottom of the second column. Having a colder second column feed stream 127 according to a preferred embodiment of the invention reduces the reflux duty of the second column, which improves efficiency and lowers overall horsepower requirements.

Stream 131 exits the 2nd Column Node 1006 bottom as a liquid having a temperature of near −168° F. and a pressure of 274 psia. Stream 131 then enters 4th Heat Exchanger Node 1007 (external reboiler that receives heat (Q-4) from stream 124 exiting the 3rd Heat Exchange Node 1005) where it is heated and partially split into stream 132. Stream 132 reenters the Column Node 1006 as a partially vapor and partially liquid stream. Stream 132 has a temperature of −166° F. and a pressure of 274 psia. The remainder of stream 131 exits 4th Heat Exchanger Node 1007 and is split into streams 142, 143, and 144, which are the bottoms liquids streams from Column Node 1006. Streams 142, 143, and 144 exit from 4th Heat Exchanger Node 1007 with stream 144 entering 5th Heat Exchange Node 1008 and streams 142 and 143 entering 3nd Heat Exchange Node 1005.

5th Heat Exchange Node 1008 comprises at one shell and tube type heat exchanger. This heat exchanger is located inside of the 2nd Fractionating Column Node 1006 as an internal falling film type exchanger (internal reflux condenser that is mounted inside the Column Node 1006 and is known in the industry as a vertical tube, falling film style exchanger or an internal "knockback" condenser of the type disclosed in U.S. Patent Application Publication 2007/0180855, incorporated herein by reference). Node 1009 is an external conventional shell and tube type exchanger used to subcool the refrigerant feed stream into the internal reflux condenser. Internal stream 128, contains approximately 95% nitrogen and 5% methane at −246° F., feeds the internal reflux condenser (part of Heat Exchange Node 1008) in $2^{nd}$ Fractionating Column Node 1006. The liquid stream 129 exits the Heat Exchange Node 1008 to provide reflux to the $2^{nd}$ Fractionating Column Node 1006.

The liquid produced from the bottom of the $2^{nd}$ Fractionating Column Node 1006 exits and is split into streams 142, 143, and 144. Stream 144 passes from the $2^{nd}$ Fractionating Column Node 1006 and into the subcooler portion of $5^{th}$ Heat Exchanger Node 1008. Here the stream is cooled from approximately −166° F. to −245° F. From the subcooler portion of Heat Exchange Node 1008, the stream feeds another JT valve (secondary JT) where the temperature is again dropped due to the JT effect to near −255° F. This stream is the refrigerant used in the internal reflux condenser of Heat Exchanger Node 1008. The refrigerant stream exits the $5^{th}$ Heat Exchanger Node 1008 as stream 148 and enters in the $7^{th}$ Heat Exchanger Node 1009 at a temperature of near −254.8° F. where it is warmed to −190° F. Stream 149 enters the $3^{rd}$ Heat Exchange Node 1005 and exits warmed to 100° F. as stream 150.

Stream 143 has a slightly lower pressure and temperature than stream 142 and is near −189° F. with a pressure of 165 psia while stream 142 has a temperature of −201° F. and a pressure of 115 psia. The benefit of allowing a portion of the bottom liquid to exit at this reduced pressure and temperature stream is to optimize the overall system heat exchange in Node 1005. By optimizing the heat exchange in Node 1005, the amount of compression required to enter a typical sales gas pipeline is again reduced. Stream 143 enters the Heat Exchange Node 1005 and exits as stream 151 at approximately 100° F. Stream 142 enters the Heat Exchange Node 1005 and exits as stream 152 at approximately 100° F.

$2^{nd}$ Fractionating Column Node 1006 overhead vapor stream exits Heat Exchanger Node 1008 as stream 136 at a temperature of −250° F. and a pressure of 275 psia and passes through a back pressure control valve where pressure is reduced to near atmospheric pressure. This stream then enters the $10^{th}$ Heat Exchanger Node 1010 to be warmed from −250° F. to approximately −185° F. exiting as stream 137 before entering $3^{nd}$ Heat Exchanger Node 1005. Stream 137 is warmed in Node 1005 to 100° F. and exits as nitrogen vent stream 155. Vent stream 155 contains approximately 98% nitrogen, 2.0% methane and a trace amount of ethane at a temperature and pressure of approximately 100° F. and 265 psia. Vent stream 155 may be recycled for supplying enhanced oil and gas recovery efforts since it is ultra dry and contains 98-99% nitrogen. This stream is also suitable for liquefaction if desired.

There are several methane enriched streams produced in Processing Steps 103 and 104. From Processing Stage 103, these streams are 120 and 122. Streams 120 and 122 are essentially the bottom streams from the $1^{st}$ Fractionating Column Node 1002, as described above, and contain approximately 1% nitrogen, 86% methane, and 8% ethane. Stream 120 is only at a pressure of around 120 psia, so it is necessary to compress stream 120 in Processing Stage 105 in order to increase the pressure of this stream to an appropriate level for processed sales gas. Stream 122 is the high pressure methane enriched stream exiting from Node 1000, at a pressure of around 1060 psia. It is not necessary to further compress this stream. From Processing Stage 104, the methane enriched streams are streams 150, 151, and 152, which are essentially the bottom stream from the $2^{nd}$ Fractionating Column Node 1006. Streams 150, 151, and 152, are each at different pressures, increasing from the low pressure stream 150 (at 15 psia) to the high pressure stream 152 (at 271 psia). Referring to FIG. 1C, streams 120, 150, 151, and 152 all feed into compressor Node 1011, where they pass through compression stages. As the lowest pressure stream, stream 150 enters Node 1011 first, emerging as stream 167 at a pressure and temperature suitable for pipeline transportation. Within the interstages of Node 1011, additional side streams 120, 151, and 152 are introduced and combined with the upstream streams as indicated on FIG. 1C where interstage pressures are ideal. Stream 122, which is already at approximately 1060 psia, is combined with stream 167 downstream of Compressor Node 1011 to form a final product sales stream 185. Compression will be further understood by those of ordinary skill in the art.

Acceptable inlet compositions in which this invention may operate satisfactorily are listed in the following Table 1:

TABLE 1

INLET STREAM COMPOSITIONS

| Inlet Component | Acceptable Inlet Composition Ranges |
|---|---|
| Methane | 20-95% |
| Ethane and Heavier Components | 0-50% |
| Carbon Dioxide | 0-100 ppm |
| Nitrogen | 5-50% |

The flow rates, temperatures and pressures of various flow streams referred to in connection with the discussion of the system and method of the invention in relation to FIGS. 1, 1A, 1B and 1C, are based on a computer simulation for System 10 having a feed gas flow rate of 250 MMSCFD containing 25% nitrogen and 70% methane and 25 ppm of carbon dioxide, appear in Table 2 below. The values for energy streams referred to in connection with the discussions of the system and method of the invention in relation to FIGS. 1A, 1B and 1C appear in Table 3 below. The temperatures, pressures, flow rates, and compositions will vary depending on the nature of the feed stream and other operational parameters as will be understood by those of ordinary skill in the art.

TABLE 2

FLOW STREAM PROPERTIES-Minimum Recompression Case

| Stream Reference Numeral | % N2 | % CH4 | Molar Flow (lbmol/h) | Std Vapor Volumetric Flow (MMSCFD) | Temperature (° F.) | Pressure (psia) |
|---|---|---|---|---|---|---|
| 101 | 25.0 | 70.0 | 26164 | 250 | 115 | 865 |
| 106 | 25.0 | 70.0 | 14867 | 142 | −75 | 860 |
| 102 | 25.0 | 70.0 | 26164 | 250 | −75 | 860 |
| 107 | 25.0 | 70.0 | 11297 | 108 | −75 | 860 |
| 109 | 25.0 | 70.0 | 11297 | 108 | −186 | 564 |
| 110 | 38.8 | 60.9 | 16631 | 159 | −156 | 564 |
| 111 | 2.0 | 90.3 | 17951 | 172 | −123 | 569 |
| 112 | 3.2 | 95.3 | 8418 | 80 | −117 | 569 |
| 114 | 1.0 | 85.8 | 3813 | 36 | −117 | 569 |
| 116 | 1.0 | 85.8 | 5720 | 55 | −189 | 125 |
| 117 | 1.0 | 85.8 | 3813 | 36 | −108 | 1065 |
| 119 | 25.0 | 70.0 | 14867 | 142 | −127 | 720 |

TABLE 2-continued

FLOW STREAM PROPERTIES-Minimum Recompression Case

| Stream Reference Numeral | % N2 | % CH4 | Molar Flow (lbmol/h) | Std Vapor Volumetric Flow (MMSCFD) | Temperature (° F.) | Pressure (psia) |
|---|---|---|---|---|---|---|
| 120 | 1.0 | 85.8 | 5720 | 55 | 75 | 120 |
| 121 | 38.8 | 60.9 | 16631 | 159 | 110 | 559 |
| 122 | 1.0 | 85.8 | 3813 | 36 | 110 | 1060 |
| 123 | 38.8 | 60.9 | 16631 | 159 | −90 | 557 |
| 124 | 38.8 | 60.9 | 10928 | 104 | −90 | 557 |
| 125 | 38.8 | 60.9 | 5703 | 55 | −90 | 557 |
| 126 | 38.8 | 60.9 | 5703 | 55 | −180 | 556 |
| 127 | 38.8 | 60.9 | 5703 | 54 | −211 | 349 |
| 128 | 94.7 | 5.3 | 19682 | 188 | −246 | 274 |
| 129 | 93.0 | 7.0 | 13204 | 126 | −251 | 274 |
| 131 | 2.0 | 97.7 | 15392 | 147 | −168 | 274 |
| 132 | 4.0 | 95.9 | 5240 | 50 | −166 | 274 |
| 135 | 38.8 | 60.9 | 10928 | 104 | −182 | 349 |
| 136 | 98.0 | 2.0 | 6479 | 62 | −251 | 274 |
| 137 | 98.0 | 2.0 | 6479 | 62 | −185 | 269 |
| 142 | 1.0 | 98.6 | 609 | 6 | −166 | 273 |
| 143 | 1.0 | 98.6 | 1780 | 17 | −201 | 115 |
| 144 | 1.0 | 98.6 | 7763 | 74 | −166 | 274 |
| 147 | 0.95 | 98.5 | 7763 | 74 | −254 | 20 |
| 148 | 0.95 | 98.5 | 7763 | 74 | −254 | 17 |
| 149 | 1.0 | 98.6 | 7763 | 74 | −190 | 16 |
| 150 | 1.0 | 98.6 | 7763 | 74 | 80 | 15 |
| 151 | 1.0 | 98.6 | 1780 | 17 | 100 | 111 |
| 152 | 1.0 | 98.6 | 609 | 6 | 100 | 271 |
| 155 | 98.0 | 2.0 | 6479 | 62 | 100 | 264 |
| 167 | 1.0 | 94.0 | 15847 | 151 | 12 | 1050 |
| 185 | 0.97 | 92.4 | 19660 | 188 | 31.6 | 1050 |

TABLE 3

ENERGY STREAM REPORT - Minimum Recompression Case

| Energy Stream | Energy Rate | Power | From Block | To Block |
|---|---|---|---|---|
| Q-1 | 0.389 MMBtu/h | 114.042 kW | — | LNG Pump |
| Q-2 | 14.09 MMBtu/h | 4129.03 kW | 1st Ht Ex Node 1000 | 2nd HT Ex Node 1004 |
| Q-3 | 13.05 MMBtu/h | 3824.60 kW | 4th Ht Ex Node 1007 | 4th Ht Ex Node 1007 |
| Q-4 | 20.71 MMBtu/h | 6068.37 kW | 2nd Frac Column Node 1006 | 5th Ht Ex Node 1008 |

It will be appreciated by those of ordinary skill in the art that these values are based on the particular parameters and composition of the feed stream in the above example. The values will differ depending on the parameters and composition of the NRU Feed stream 101.

Referring to FIGS. 2 and 2A-2D, System 20 for separating nitrogen from methane, as well as extracting NGL, according to another preferred embodiment of the invention is depicted. System 20 preferably includes processing stages 103, 104, and 105 for processing NRU feed gas stream 101 to produce a nitrogen vent stream 255 and a processed gas stream 285, similar to System 10. System 20 also comprises processing stage 200 for extracting NGL product stream 266. Processing stages 103, 104, and 105 and the various components therein are essentially the same as discussed above with respect to System 10; however, the process conditions may differ slightly as discussed below and streams are denoted with 200 series stream numbers. Processing Stage 103 includes a first fractionating column, the overhead stream from which serves as the feed for Processing Stage 104, which includes a second fractionating column. The overhead stream from the Processing Stage 104 is a nitrogen vent stream 155. The bottoms streams from the Processing Stages 103 and 104 feed a series of compressors in Processing Stage 105 to produce processed gas of sufficient pressure and composition to be suitable for sale. The bottoms stream from Processing Stage 103 also feeds Processing Stage 200, which includes an NGL fractionating column, the overhead stream from which serves as additional feed for the Processing Stage 103. The bottoms stream from the Processing Stage 200 is the NGL product stream 266.

Figure 2:
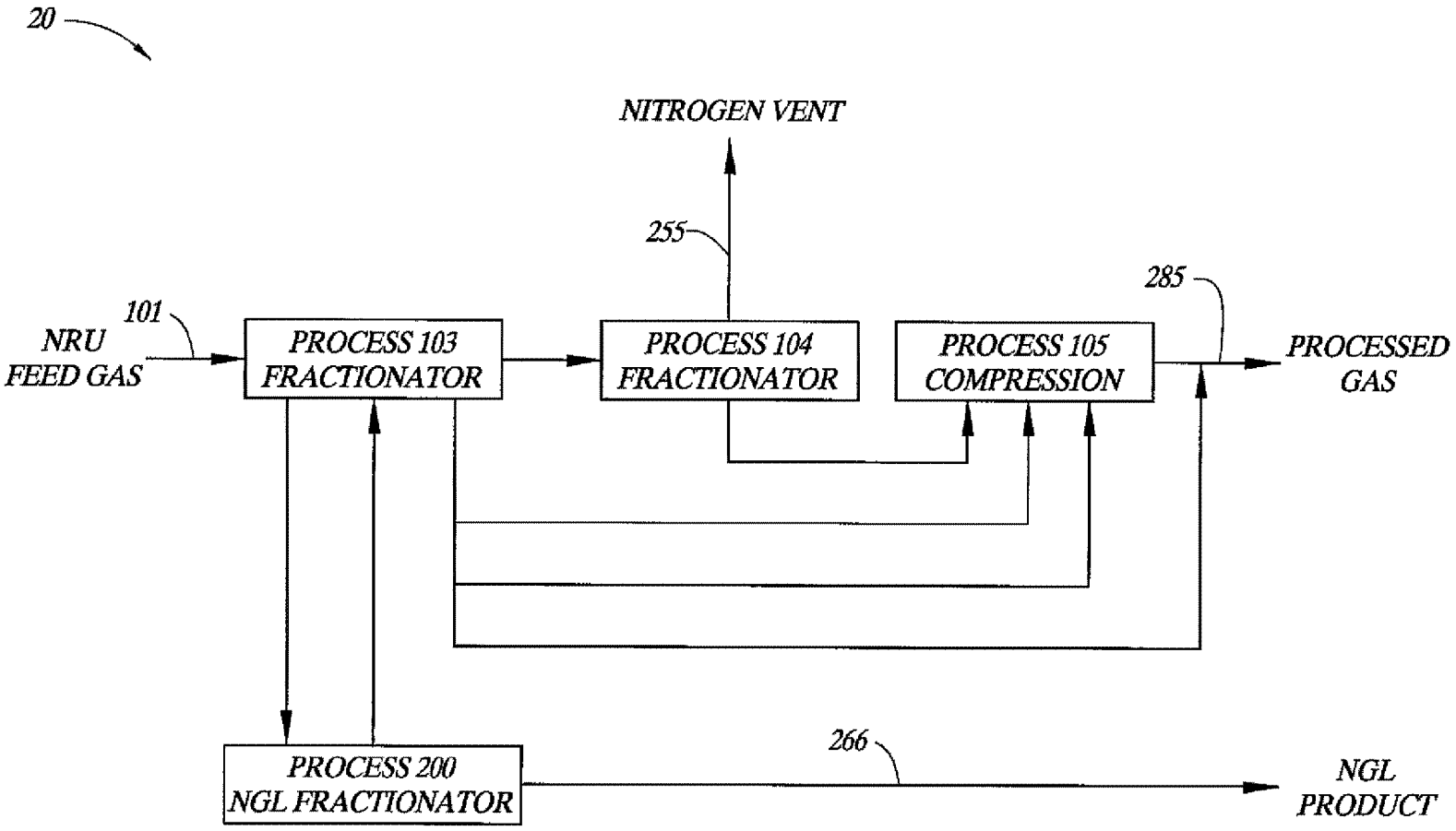
FIG. 2 is a simplified process flow diagram illustrating principal Processing Stages of another preferred embodiment of a system and method for separating nitrogen and methane including NGL extraction.
Figure 2A:
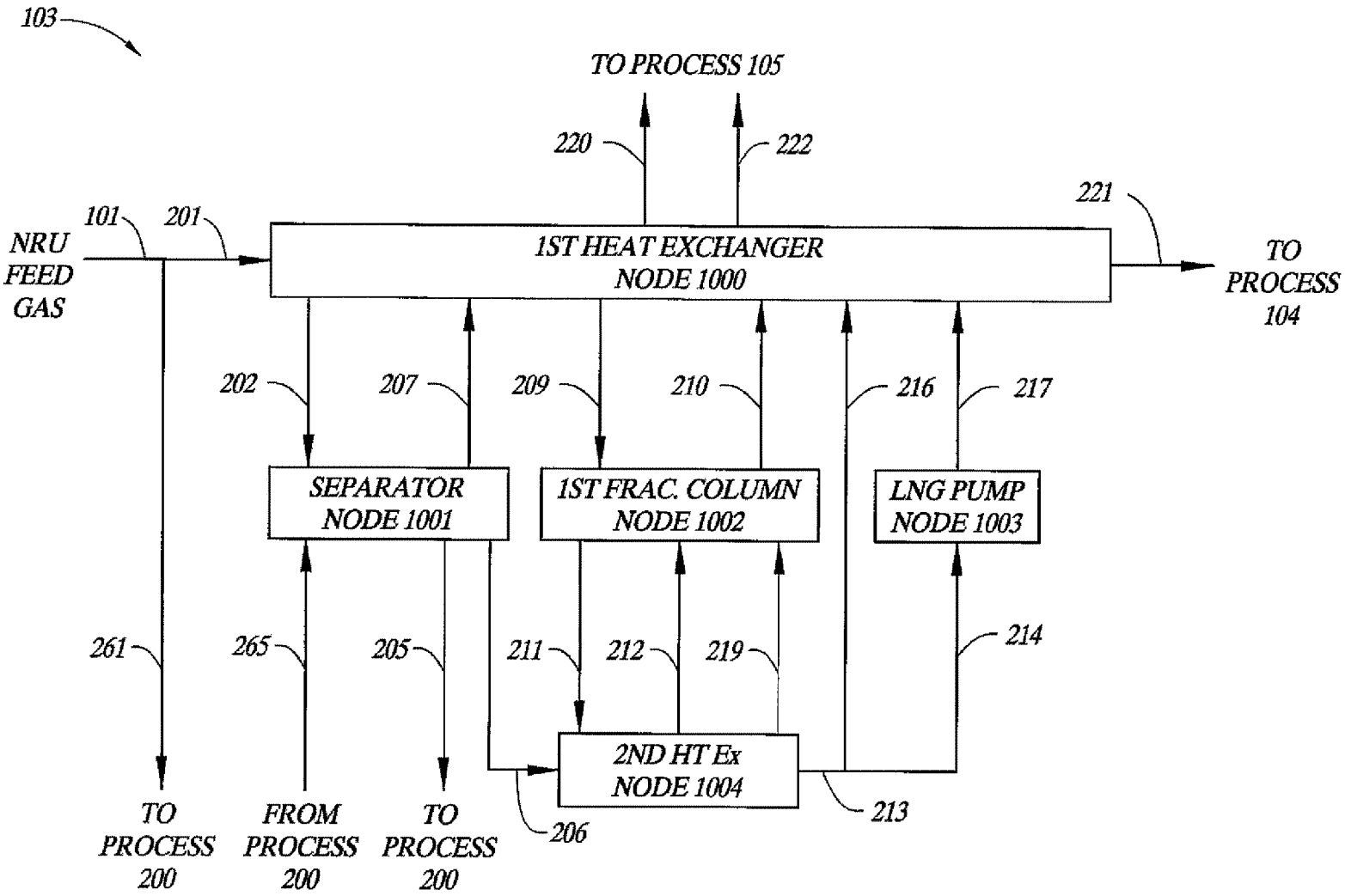
FIG. 2A is a more detailed process flow diagram illustrating a preferred embodiment of a methane and heavy hydrocarbon separation portion of the simplified process flow diagram of FIG. 2.
Figure 2B:
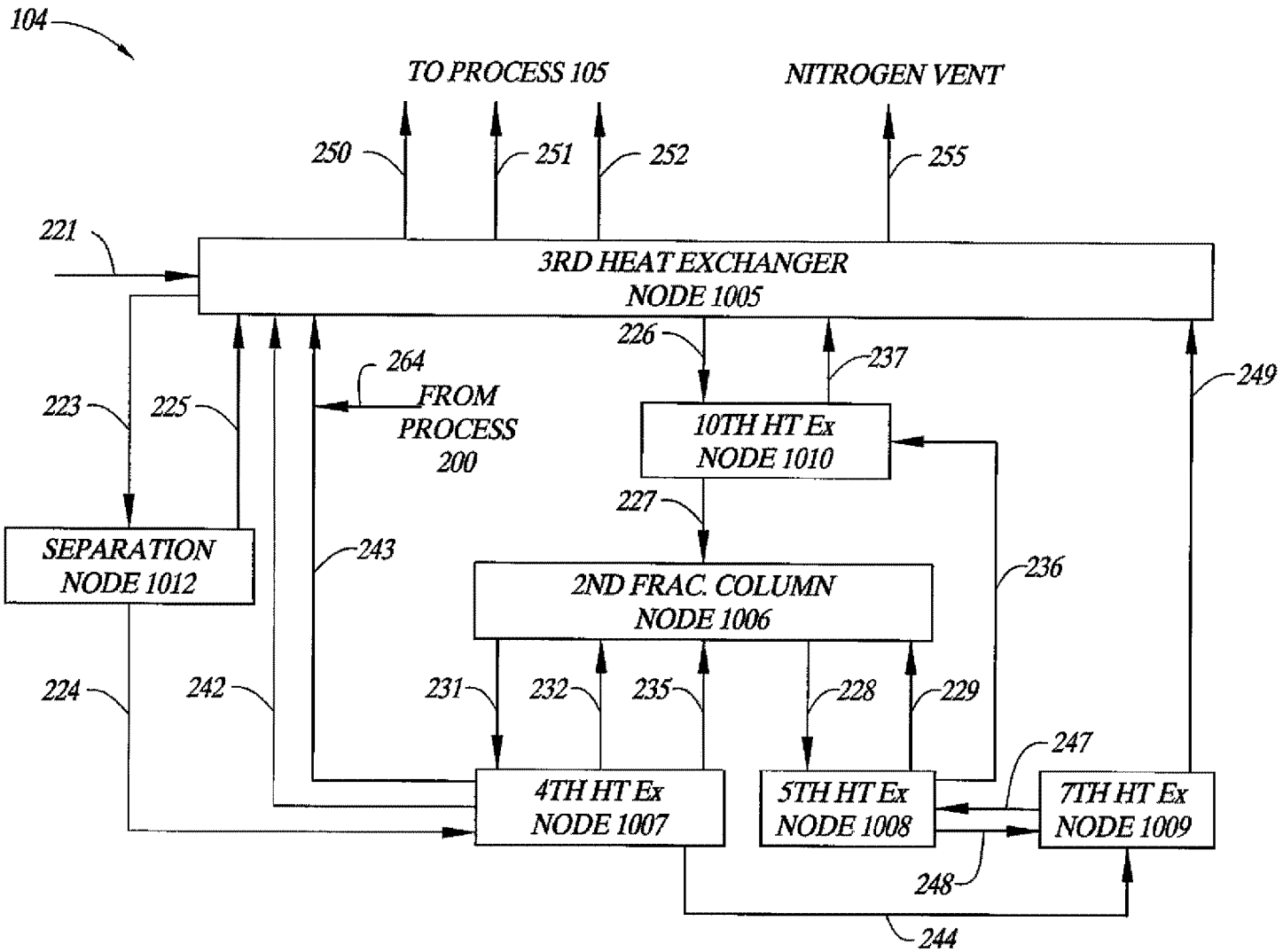
FIG. 2B is a more detailed process flow diagram illustrating a preferred embodiment of a nitrogen separation from methane portion of the simplified process flow diagram of FIG. 2.
Figure 2C:
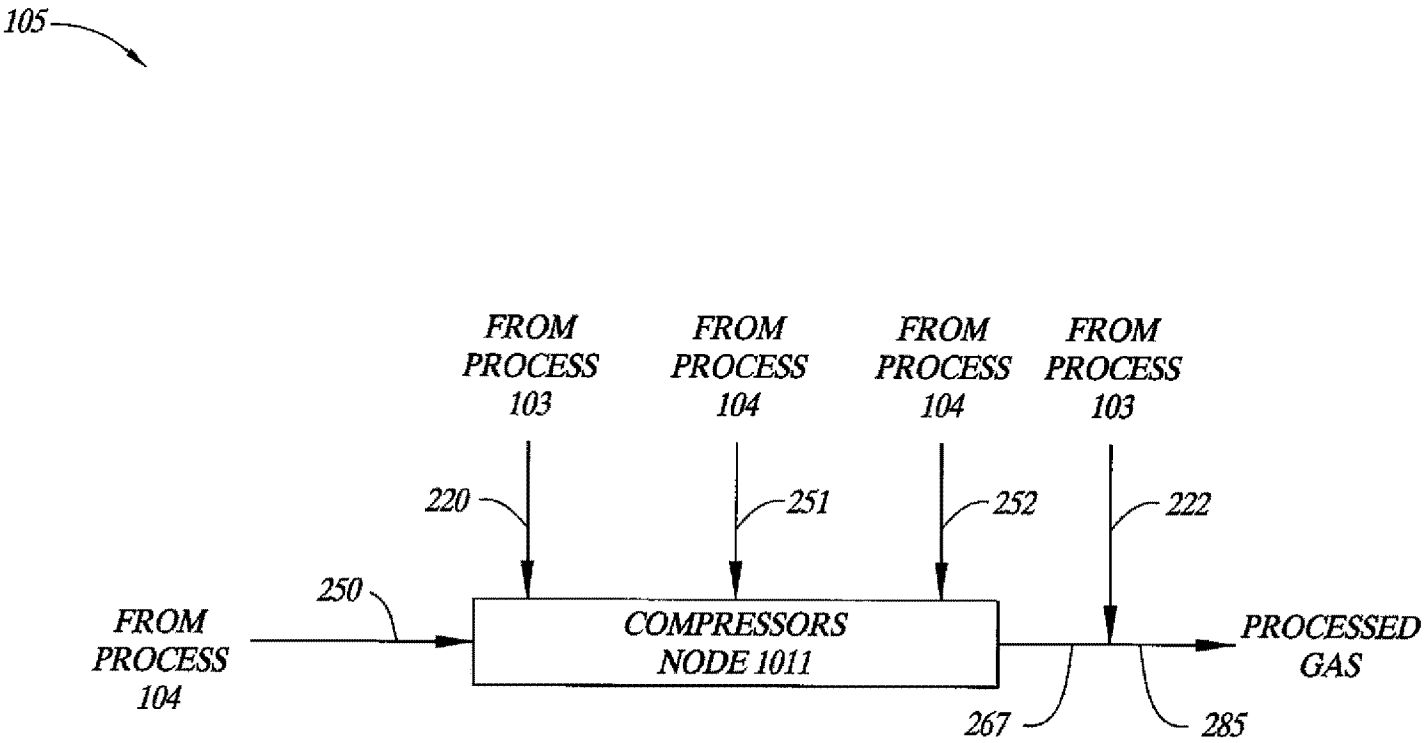
FIG. 2C is a more detailed process flow diagram illustrating a preferred embodiment of a compression portion of the simplified process flow diagram of FIG. 2.
Figure 2D:
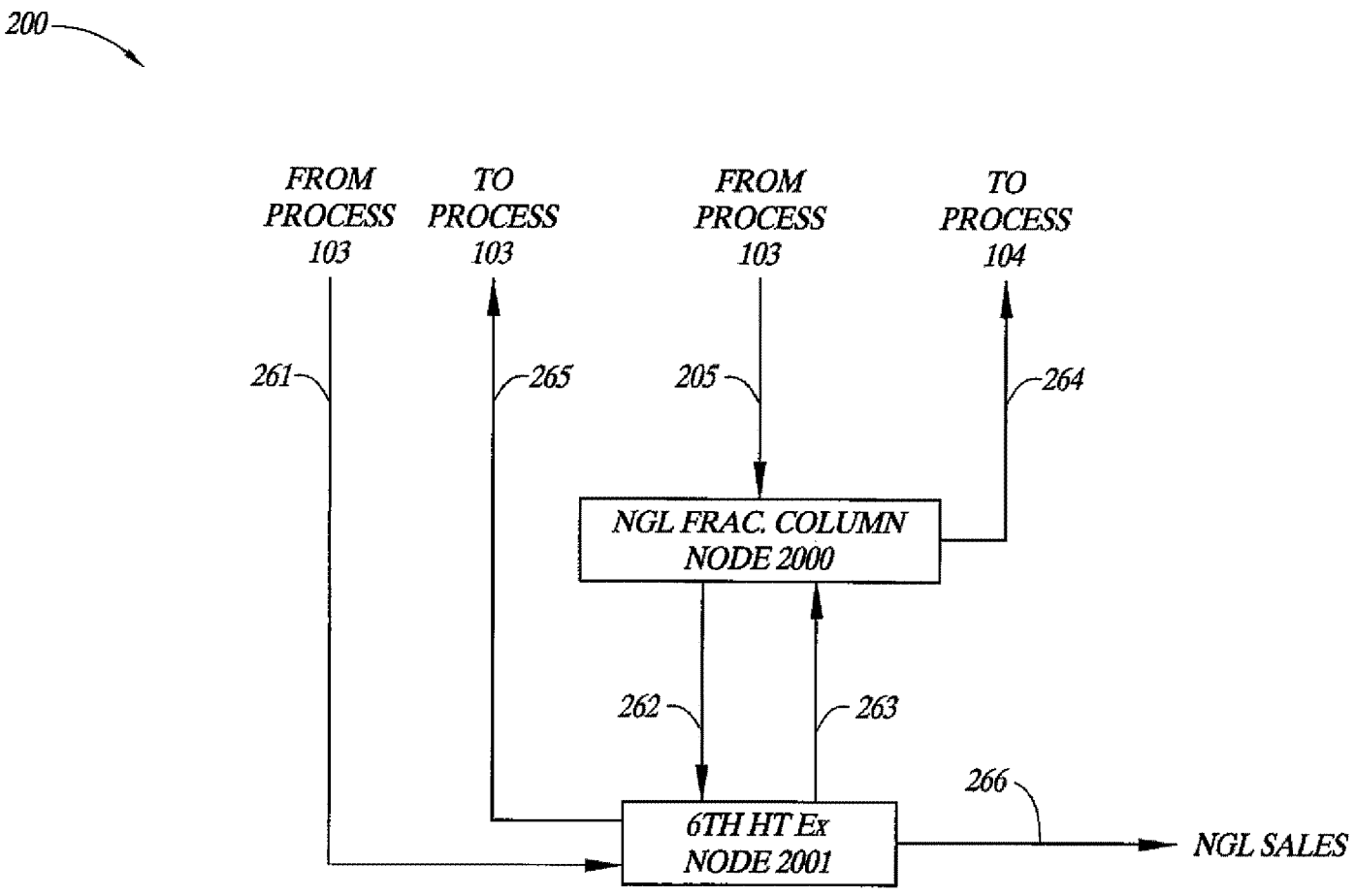
FIG. 2D is a more detailed process flow diagram illustrating a preferred embodiment of an NGL extraction portion of the simplified process flow diagram of FIG. 2.

Referring to FIG. 2A, a 250 MMSCFD NRU feed stream 101 containing 25% nitrogen, 70% methane, 3% ethane, 1% propane, 1% butane and heavier components, and 25 ppm of carbon dioxide at 115° F. and 865 psia passes into a splitter where one stream 201 is fed into the 1$^{st}$ Heat Exchanger Node 1000 and the second stream 261, is feed into the 6$^{th}$ Heat Exchanger Node 2001 in the NGL extraction processing stage 200, as shown in FIG. 2D and discussed below. The 1$^{st}$ Heat exchanger block 1000 is preferably a plate-fin heat exchanger, from which stream 201 emerges as stream 202 having been cooled to −50° F. The cooled feed stream 202 feeds into a Separation Node 1001 where phase separation also occurs along with stream 265 (from Processing Stage 200) where they are mixed and then split into streams, 205, 206, and 207. Stream 205 is the liquid portion of the combination of streams 265 and 202 and is routed to the NGL Frac Column Node 2000 for further processing. Stream 206 exits the Separation Node 1001 in vapor phase as the singular heat source for the 2$^{nd}$ Heat Exchanger Node 1004. By supplying heat to Node 1004, stream 206 is cooled to approximately −111° F. and is then reduced in pressure by a JT valve. This pressure reduction coupled with the reduction of heat from Node 1004 creates stream 219 with a temperature of −121° F. and a pressure of 615 psia which is then fed into the 1$^{st}$ Fractionating Column Node 1002 at a strategic point lower in the column than the feed stream 209, similar to streams 109 and 199 as described above.

Stream 207 exits the Separation Node 1001 in vapor phase and re-enters the 1$^{st}$ Heat Exchanger Node 1000 where it is cooled to near −183° F. The same stream then is routed to a JT pressure reducing valve and emerges as stream 209 with a temperature of near −183° F. and a pressure of near 615 psia. Stream 209 is then fed into the 1$^{st}$ Fractionating Column Node 1002 as the top feed stream. Column Node 1002 operates at approximately −110° F. to −150° F. and 615 psia, and causes the nitrogen gas to separate from the methane and flow upwardly through the column as a vapor. The methane and other hydrocarbon components are gravity driven to the bottom of the column where they exit as stream 211. Bottoms stream 211 enters 2$^{nd}$ Heat Exchange Node 1004 where heat is added (Q-2 in Table 7) to produce vapor stream 212 (partially vaporized) and liquid stream 213 to Node 1004. Vapor stream 212 is then routed back into the 1$^{st}$ Fractionating Column.

The liquid stream 213 exits from 2$^{nd}$ Heat Exchange Node 1004 and is split two streams. The first liquid split stream is stream 214. Under the parameters of the specific example and operating conditions described herein, this splitter is set so that approximately 25% of the liquid stream 213 is directed to stream 214. Stream 214 is pumped by an LNG pump Node 1003 from a pressure of approximately 570 psia to near 1065 psia (stream 217) before entering 1$^{st}$ Heat Exchanger Node 1000. The LNG pump is optional, but has the potential to save in compression horsepower requirements in Node 1011. Stream 217 enters the Heat Exchange Node 1000 at around −101° F. and exits as stream 222 at a temperature of near 103° F. and a pressure of approximately 1060 psia. The second liquid split stream is routed to a pressure reducing control valve (JT Valve) and exits as stream 216, having temperature of −188° F. and a pressure of 125 psia. Stream 216 then enters 1$^{st}$ Heat Exchanger Node 1000, exiting as stream 220 at around 103° F. and 120 psia.

Overhead stream 210 containing approximately 36% nitrogen and 61% methane at −156° F., exits the 1$^{st}$ Fractionating Column Node 1002. It is not necessary to use a reflux stream in the 1$^{st}$ Fractionating Column Node 1002 according to the invention. Overhead stream 210 is warmed to approximately 103° F. in 1$^{st}$ Heat Exchanger Node 1000 and exits Node 1000 as stream 221. It is not necessary to use a reflux stream in the 1$^{st}$ Fractionating Column Node 1002 according to the invention and overhead stream 210 is preferably not condensed through exchange Node 1000 prior to entering 3$^{rd}$ Heat Exchange Node 1005 (as stream 221). The operating parameters for the fractionation column in Node 1002 allow sufficient separation of nitrogen and methane without reflux; however, a reflux stream and related equipment could be used with the 1$^{st}$ Column of System 20 if desired.

As shown on FIG. 2B, stream 221 then passes through 3$^{nd}$ Heat Exchange Node 1005 in Processing Stage 104. The various components, Processing Stages, and stream flow in Processing Stages 104 and 105 shown on FIGS. 2B and 2C are the same as that described above with respect to Processing Stages 104 and 105 in FIGS. 1B and 1C, with the exception of the addition of stream 264 discussed below. Streams in Processing Stages 104 and 105 of System 20 are numbered to correspond to System 10 (for example, stream 136 is the 2$^{nd}$ Column overhead stream that becomes nitrogen vent stream 155 in System 10 and stream 236 is the 2$^{nd}$ Column overhead stream that becomes nitrogen vent stream 255 in System 20). The specific parameters for the streams in System 20 in this example are provided in the tables below, but for brevity the specific Processing Stages of Stages 104 and 105 in FIGS. 2B and 2C are not repeated here, but reference is made to the description of Processing Stages 104 and 105 in System 10 above.

Referring to FIG. 2D, a preferred embodiment of NGL Processing Stage 200 is shown. Stream 261, which was split from System 20 feed stream 101, enters the 6$^{th}$ Heat Exchanger Node 2001 at around 115° F. and is cooled to around −31° F., emerging as stream 265. Stream 265 is then returned to Separator Node 1001 in Processing Stage 103 as discussed above. 6$^{th}$ Heat Exchanger Node 2001 preferably comprises up to three shell and tube style heat exchangers. These heat exchangers are commonly known as the NGL stabilizer bottom reboiler, the NGL stabilizer side tray reboiler, and an optional auxiliary gas chiller and are external to the column. It should be noted the auxiliary gas chiller in the 6$^{th}$ Heat Exchanger Node 2001 will require supplemental refrigeration for the extraction of NGL from the NRU Feed Gas.

Stream 205 is the liquid portion of the combination of streams 265 and 202 from Separator Node 1001 and serves as the feed stream for the NGL Fractionating Column Node 2000. Bottoms stream 262 exits NGL Fractionating Column Node 2000 at a pressure of 253 psia and a temperature of approximately −19° F. and enters 6$^{th}$ Heat Exchanger Node 2001. Heat (Q-4 in Table 7) is added to that stream in order to reduce the impurities from the final NGL product (stream 266) as the supplied heat source is from stream 261. After heat is added to stream 262, the vapor portion is returned to the NGL Fractionating Column Node 2000 as stream 263 where the separation of vapor from liquid occur in the fractionation column bottom section. The stabilized liquid portion, or liquid that meets targeted NGL specifications, then exits Node 2001 as stream 266 as the NGL sales gas stream. Overhead vapor stream 264 exits from NGL Fractionating Column Node 2000 with a temperature of approximately −75° F. and a pressure of 285 psia. This stream is then combined with the high pressure stream 243 (one of the streams split from the bottoms of 2$^{nd}$ Fractionating Column 1006) prior to entering the 3$^{rd}$ Heat Exchanger Node 1005 where it is reheated to near 110° F. and exits the heat exchanger as stream 252.

In this example, the NRU feed stream 201 contains 25 ppm carbon dioxide. However, System 20 is capable of processing NRU feed streams containing up to 100 ppm carbon dioxide as previously discussed. The 1$^{st}$ Column bottoms stream 211 (and streams 214 and 216 split from stream 211) of the 1$^{st}$ Fractionating Column Node 1002, does not feed the 2$^{nd}$ Fractionating Column Node 1006 so the carbon dioxide containing stream does not enter the cryogenic section of the process (Processing Stage 104). The 1$^{st}$ Column overhead stream 210 (which becomes stream 221 upon exiting Node 1000) which contains only 6 ppm carbon dioxide, feeds the 2$^{nd}$ Fractionating Column Node 1006; however, this small amount of carbon dioxide does not create significant freeze-out problems. The carbon dioxide tolerance of System 20 according to the invention is increased from a maximum of around 35 ppm in prior systems to a maximum of around 100 ppm for typical nitrogen levels in the NRU feed stream.

Acceptable inlet compositions in which this invention may operate satisfactorily are listed in the following Table 4:

TABLE 4

INLET STREAM COMPOSITIONS - NGL Recovery

| Inlet Component | Acceptable Inlet Composition Ranges |
|---|---|
| Methane | 20-95% |
| Ethane and Heavier Components | 0-50% |
| Carbon Dioxide | 0-100 ppm |
| Nitrogen | 5-50% |

The flow rates, temperatures and pressures of various flow streams referred to in connection with the discussion of System 20 and the method of the invention in relation to FIGS. 2A, 2B, 2C and 2D, are based on a computer simulation for System 20 having a feed gas flow rate of 250 MMSCFD containing 20% nitrogen, 61% methane, 11% ethane, 5% propane, 3% butane and heavier components plus 25 ppm carbon dioxide, all of which appear in Tables 5 and 6 below. The values for the energy streams referred to in connection with the discussions of System 20 and the method of the invention in relation to FIGS. 2A, 2B, 2C and 2D appear in Table 7. The temperatures, pressures, flow rates, and compositions will vary depending on the nature of the feed stream and other operational parameters as will be understood by those of ordinary skill in the art.

TABLE 5

FLOW STREAM PROPERTIES-NGL Recovery

| Stream Reference Numeral | % N2 | % CH4 | Molar Flow (lbmol/h) | Std Vapor Volumetric Flow (MMSCFD) | Temperature (° F.) | Pressure (psia) |
|---|---|---|---|---|---|---|
| 101 | 25.0 | 70.0 | 26164 | 250 | 115 | 865 |
| 201 | 25.0 | 70.0 | 24856 | 238 | 115 | 865 |
| 202 | 25.0 | 70.0 | 24856 | 238 | −50 | 860 |
| 205 | 3.9 | 36.4 | 402 | 4 | −50 | 850 |
| 206 | 25.3 | 70.5 | 13277 | 127 | −50 | 850 |
| 207 | 25.3 | 70.5 | 12485 | 119 | −50 | 850 |
| 209 | 25.3 | 70.5 | 12485 | 119 | −183 | 614 |
| 210 | 36.3 | 63.4 | 17781 | 170 | −151 | 614 |
| 211 | 1.9 | 91.3 | 17906 | 171 | −117 | 619 |
| 212 | 2.7 | 95.1 | 9925 | 95 | −110 | 619 |
| 213 | 0.9 | 86.5 | 7982 | 76 | −110 | 619 |
| 214 | 1.0 | 86.5 | 1197 | 11 | −110 | 619 |
| 216 | 1.0 | 86.5 | 6784 | 65 | −188 | 125 |
| 217 | 1.0 | 86.5 | 1197 | 11 | −101 | 1065 |
| 219 | 25.3 | 70.5 | 13277 | 127 | −121 | 720 |
| 220 | 1.0 | 86.5 | 6784 | 65 | 103 | 120 |
| 221 | 36.3 | 63.4 | 17781 | 170 | 103 | 609 |
| 222 | 1.0 | 86.5 | 1197 | 11 | 103 | 1060 |
| 223 | 36.3 | 63.3 | 17780 | 170 | −90 | 607 |
| 224 | 36.3 | 63.4 | 11222 | 107 | −90 | 607 |
| 225 | 0.0 | 3.7 | 241 | 2 | 99 | 253 |
| 226 | 36.3 | 63.3 | 6558 | 63 | −190 | 606 |
| 227 | 36.3 | 63.4 | 6558 | 63 | −223 | 349 |
| 228 | 95.1 | 4.9 | 19084 | 182 | −244 | 294 |
| 229 | 93.5 | 6.5 | 12622 | 121 | −249 | 294 |
| 231 | 2.1 | 97.5 | 17636 | 169 | −165 | 294 |
| 232 | 4.0 | 95.9 | 6317 | 60 | −163 | 294 |
| 235 | 36.3 | 63.4 | 11222 | 107 | −183 | 349 |
| 236 | 98.0 | 2.0 | 6462 | 62 | −249 | 294 |
| 237 | 98.0 | 2.0 | 6462 | 62 | −195 | 289 |
| 242 | 1.0 | 98.4 | 1348 | 13 | −198 | 125 |
| 243 | 1.5 | 97.6 | 2707 | 26 | −170 | 250 |
| 244 | 1.0 | 98.4 | 7424 | 71 | −163 | 294 |
| 247 | 1.0 | 98.4 | 7424 | 71 | −254 | 20 |
| 248 | 1.0 | 98.4 | 7424 | 71 | −255 | 17 |
| 249 | 1.0 | 98.4 | 7424 | 71 | −200 | 16 |
| 250 | 1.0 | 98.4 | 7424 | 71 | 79 | 15 |
| 251 | 1 | 98.4 | 1348 | 13 | 79 | 121 |
| 252 | 1.5 | 97.6 | 2707 | 26 | 79 | 248 |
| 255 | 98.0 | 2.0 | 6462 | 62 | 79 | 284 |
| 261 | 25.0 | 70.0 | 1308 | 13 | 115 | 865 |
| 262 | 0.0 | 12.5 | 324 | 3 | −19 | 253 |
| 263 | 0.0 | 38.2 | 83 | 1 | 99 | 253 |
| 264 | 9.7 | 85.5 | 161 | 2 | −76 | 250 |
| 265 | 25.0 | 70.0 | 1308 | 13 | −31 | 855 |
| 266 | 4.9E−7 | 3.7 | 241 | 2 | 99 | 253 |
| 267 | 1.1 | 93.8 | 18264 | 175 | 120 | 1050 |
| 285 | 1.1 | 93.4 | 19461 | 186 | 119 | 1050 |

TABLE 6

FLOW STREAM PROPERTIES - NGL Recovery

| Stream Reference Numeral | % $N_2$ | % $CH_4$ | % $C_2H_3$ | % $C_3H_8$ |
|---|---|---|---|---|
| 202 | 25.0 | 70.0 | 3 | 1 |
| 225 | trace | 3.7 | 15 | 19 |
| 262 | trace | 12.5 | 20 | 18 |
| 263 | trace | 38.2 | 35 | 16 |
| 265 | 25.0 | 70.0 | 3 | 1 |

TABLE 7

ENERGY STREAM REPORT - NGL Recovery

| Energy Stream | Energy Rate | Power | From Block | To Block |
|---|---|---|---|---|
| Q-1 | 0.115 MMBtu/h | 33.5753 kW | — | LNG Pump |
| Q-2 | 14.09 MMBtu/h | 4129.03 kW | 1st Ht Ex Node 1000 | 2nd HT Ex Node 1004 |
| Q-3 | 1.427 MMBtu/h | 418.198 kW | NRU Feed Gas | 6th Ht Ex Node 2001 |
| Q-4 | 0.634 MMBtu/h | 185.820 kW | Supplemental Refrigeration | Separation Node 1001 |
| Q-5 | 15.28 MMBtu/h | 4478.22 kW | 4th Ht Ex Node 1007 | 4th Ht Ex Node 1007 |
| Q-6 | 18.75 MMBtu/h | 5495.23 kW | 2nd Frac Column Node 1006 | 5th Ht Ex Node 1008 |

Referring to FIGS. 3 and 3A-3D, System 30 for separating nitrogen from methane, as well as an optional nitrogen vent purification or helium recovery stage, according to another preferred embodiment of the invention is depicted. System 30 preferably includes processing stages 103, 104, and 105 for processing NRU feed gas stream 101 to produce a nitrogen vent stream 355 and a processed gas stream 385, similar to Systems 10 and 20. Processing stages 103, 104, and 105 and the various components therein are essentially the same as discussed above with respect to System 10; however, the process conditions may differ slightly as discussed below and streams are denoted with corresponding 300 series stream numbers where they differ from System 10 streams. System 30 also comprises optional processing stage 300 for removing excess hydrocarbons from the nitrogen vent stream prior to venting or for recovery of helium.

Figure 3:
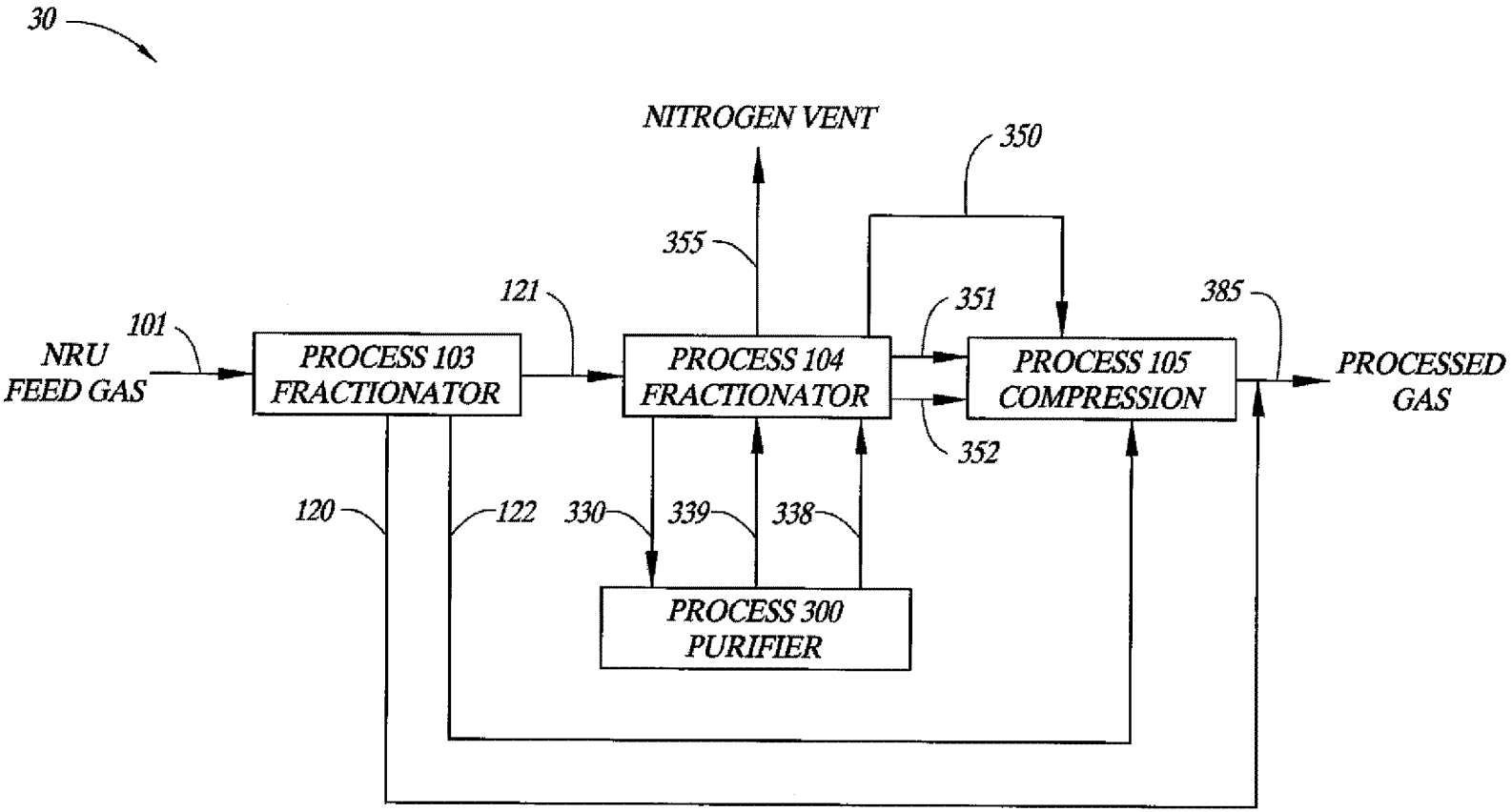
FIG. 3 is a simplified process flow diagram illustrating principal Processing Stages of another preferred embodiment of a system and method for separating nitrogen and methane including nitrogen vent purification or helium extraction.
Figure 3A:
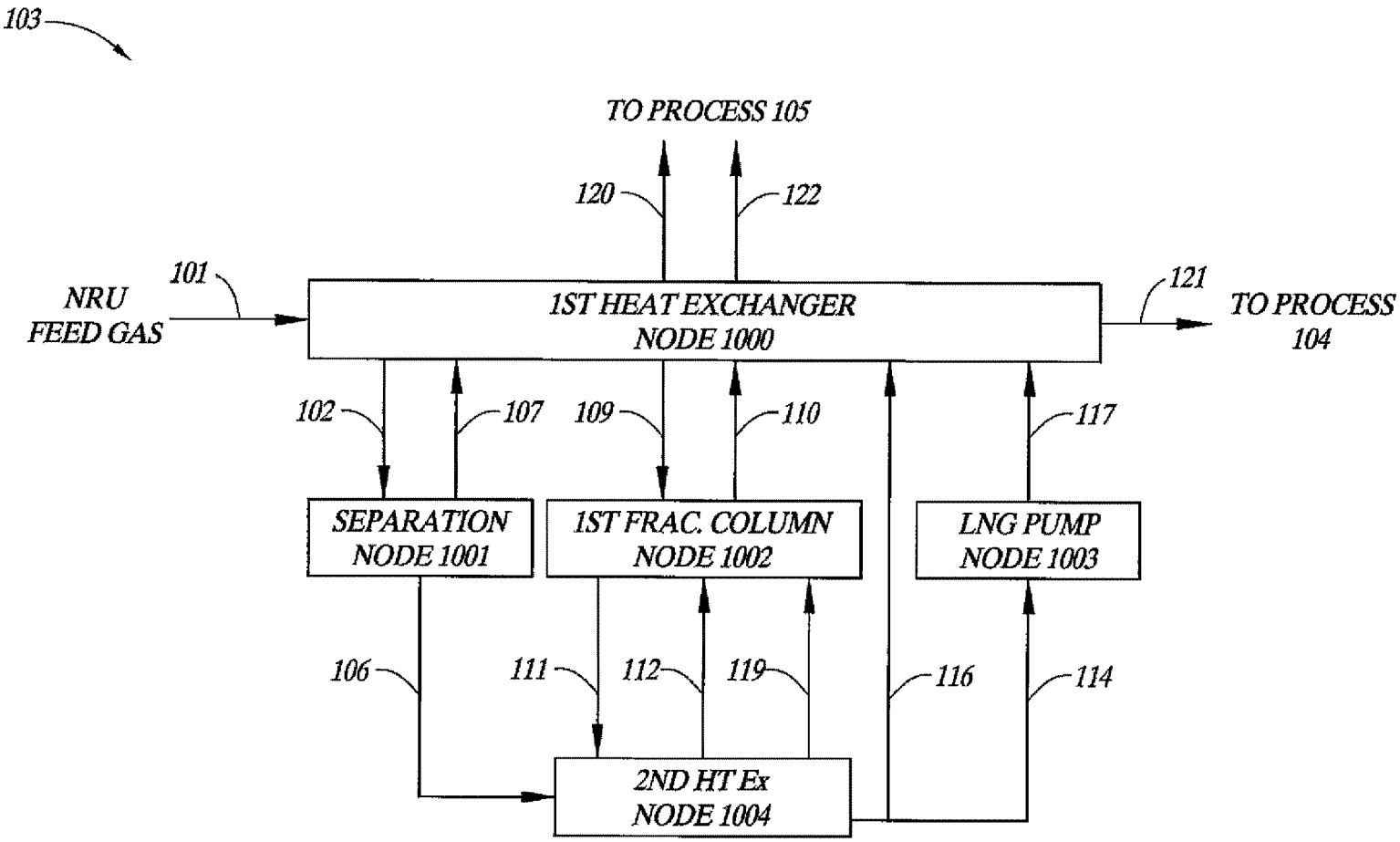
FIG. 3A is a more detailed process flow diagram illustrating a preferred embodiment of a methane and heavy hydrocarbon separation portion of the simplified process flow diagram of FIG. 3.
Figure 3B:
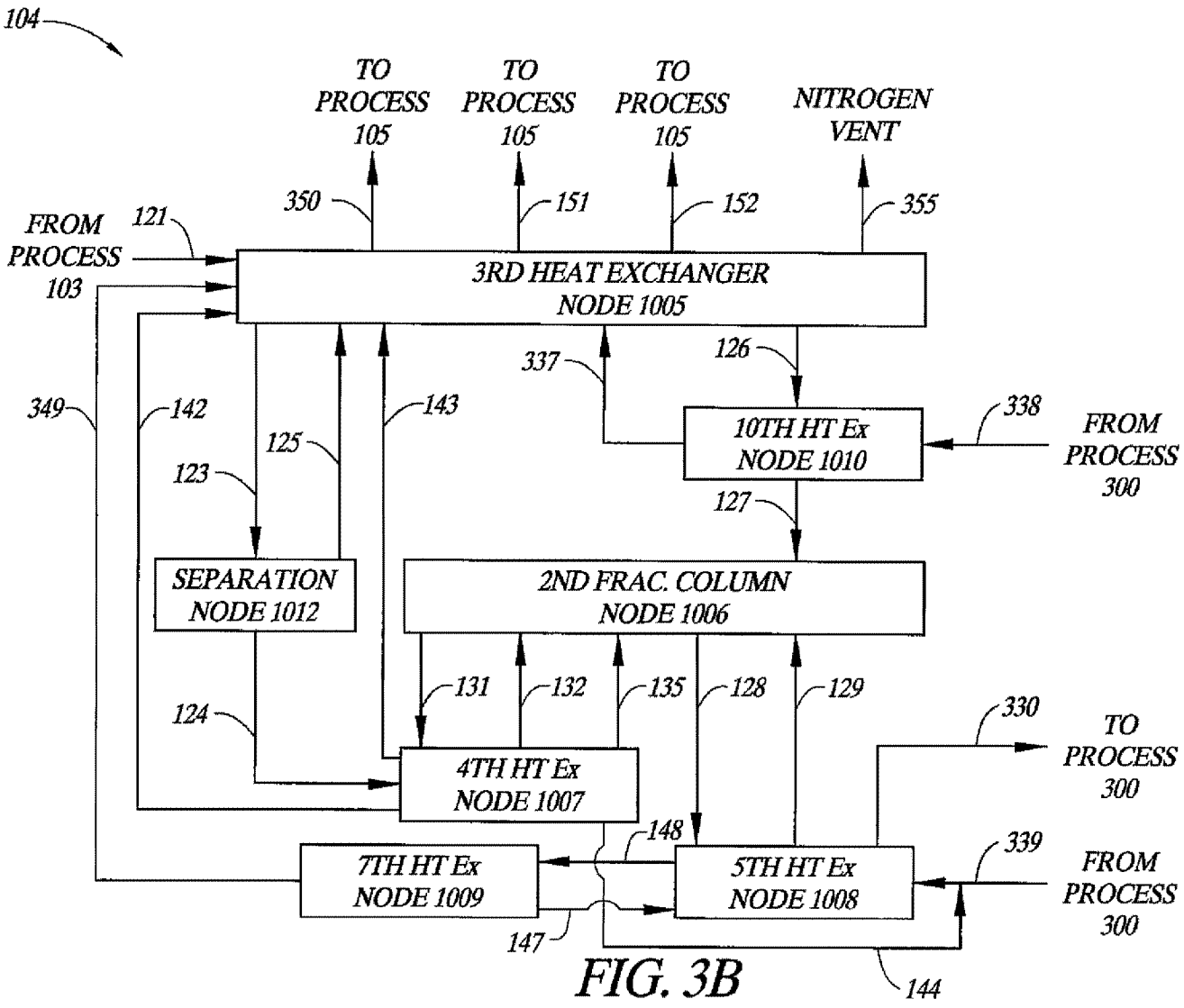
FIG. 3B is a more detailed process flow diagram illustrating a preferred embodiment of a nitrogen separation from methane portion of the simplified process flow diagram of FIG. 3.
Figure 3C:
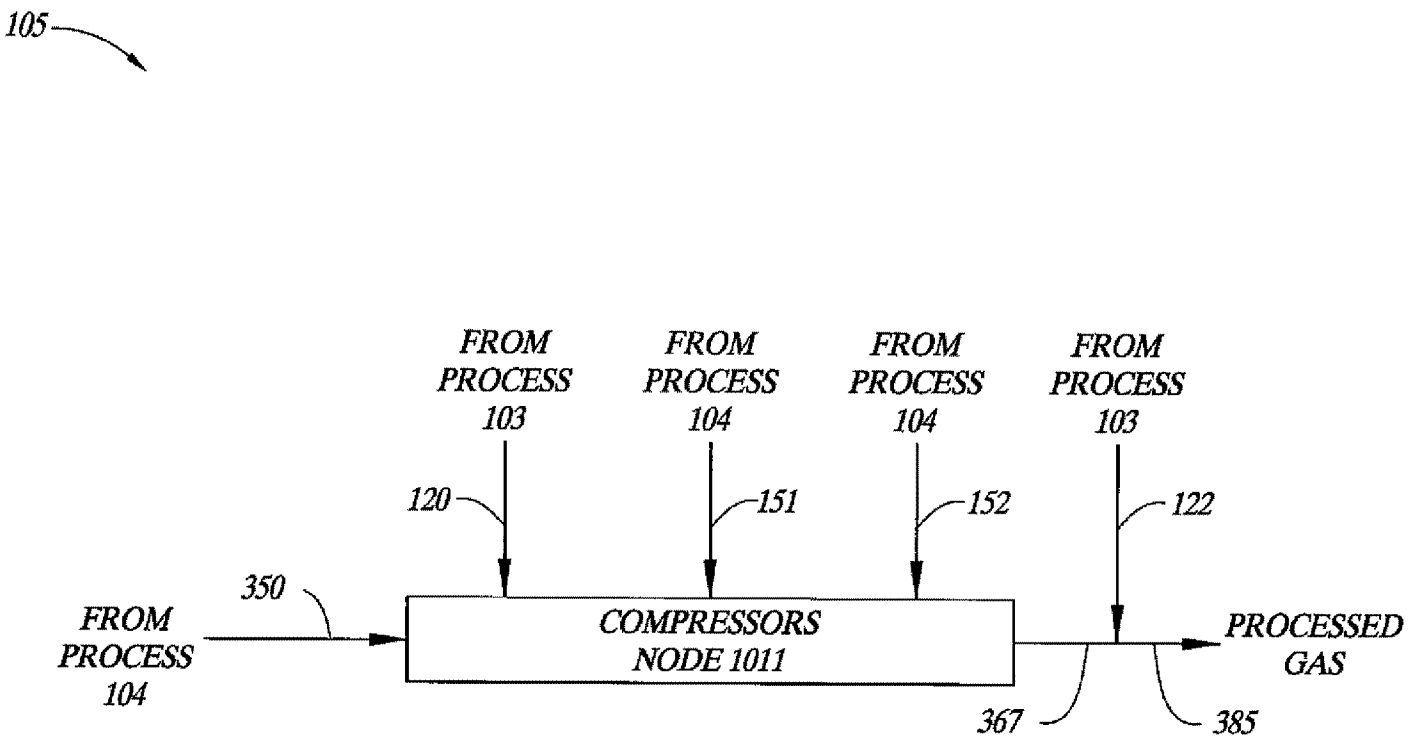
FIG. 3C is a more detailed process flow diagram illustrating a preferred embodiment of a compression portion of the simplified process flow diagram of FIG. 3.
Figure 3D:
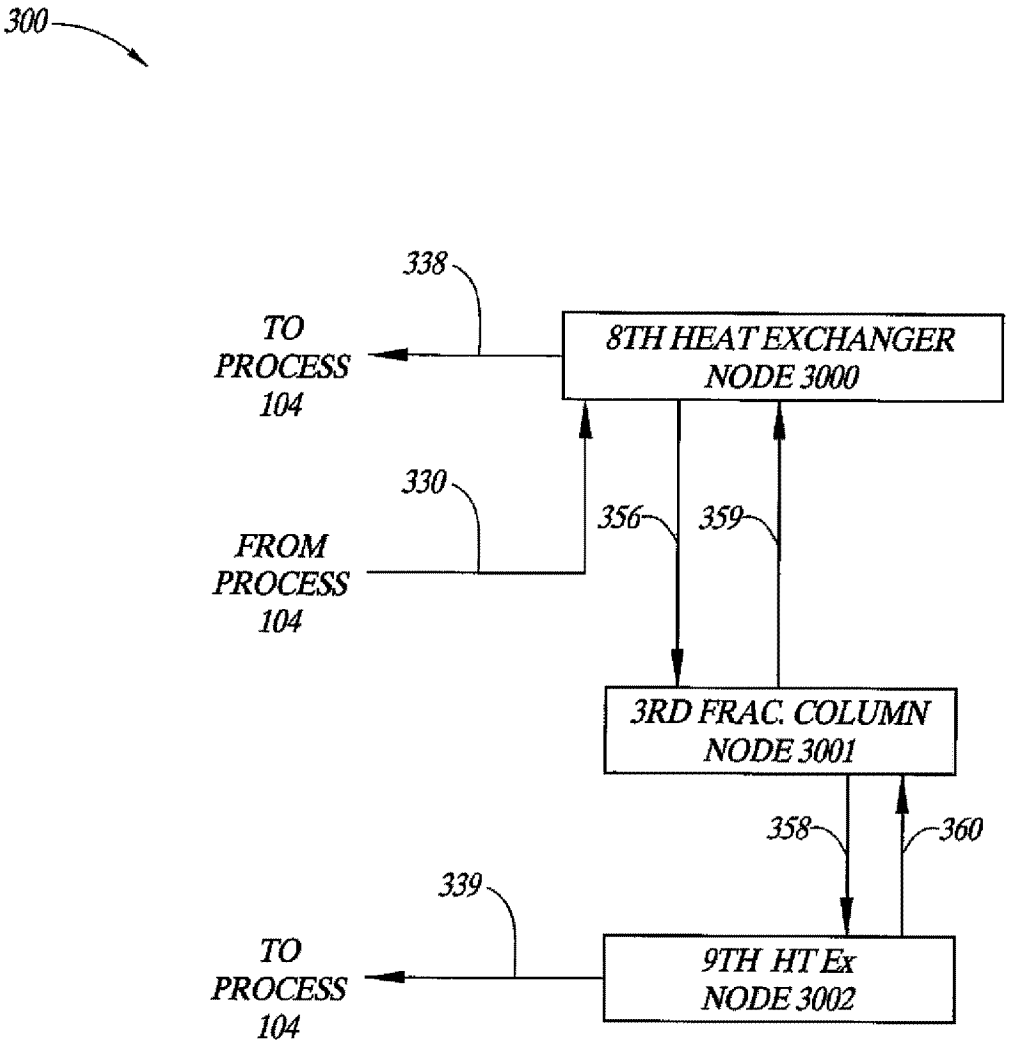
FIG. 3D is a more detailed process flow diagram illustrating a preferred embodiment of a vent purification or helium extraction portion of the simplified process flow diagram of FIG. 3.

Processing stage 300 is an optional add-on stage preferably comprising a $4^{th}$ fractionation column node 3001 (or purifier) and $8^{th}$ Heat Exchanger Node 3000 as depicted in FIG. 3D. Processing Stage 300 is particularly useful when the overhead stream from the $2^{nd}$ Fractionation Column Node 1006 in Processing Stage 104 (which becomes the nitrogen vent stream) comprises more hydrocarbons than would be permissible for venting to the atmosphere by local regulations (even 1-2% may be too high under certain environmental regulations). In the case where there are limits on the amount of methane to be vented the Processing Stage 300 is preferably used to reduce the amount of methane in the overhead stream from the $2^{nd}$ Fractionation Column Node 1006. In such cases, the overhead stream from the $2^{nd}$ Fractionation Column Node 1006 in Processing Stage 104 feeds into Processing Stage 300 to remove the excess hydrocarbons prior to venting stream 355. Processing Stage 300 may be used to achieve a 10:1 improvement or reduction in the amount of hydrocarbons in the overhead stream from the second fractionation column, so that the nitrogen may be vented with very little hydrocarbon content. Processing Stage 300 may also be used to recover helium, if the level of helium in the feed stream is sufficient to make helium recovery beneficial. Feed stream helium levels 0.05 mol % or higher may be sufficient to merit processing with Step 300. In an expanded option for Processing Stage 300, it also can be configured to provide for both an ultra low methane emission and the recovery of helium.

Referring to FIG. 3A, a 250 MMSCFD feed stream 101 containing approximately 25% nitrogen and 70% methane at 115° F. and 865 psia is processed through Processing Stage 103 in the same manner as described above with respect to System 10. To increase flexibility of System 30 in processing greater volumes of feed gas 101 having 45% or less nitrogen concentration, then the flow processing capability of stage 103 may be multiplied by using multiple fractionation columns (multiple 1st Fractionation Column Nodes 1002). A series of "stacked" fractionation systems in Processing Stage 103 may be used to feed a single fractionation column (2nd Fractionation Column Node 1006) in Processing Stage 104. For example, four fractionating columns in Processing Stage 103 may be used to process a total feed stream 101 of around 1000 MMSCFD, the overhead streams of each feeding a single 25 to 75 MMSCFD fractionating column (Node 1006) in Processing Stage 104. This ability to stack Process 103 to process larger volumes of feed gas is an advantage over the prior art, as prior art systems are limited in their physical ability to scale-up based on cost, availability of materials, and the capability to transport heavy loads due to road or transport capacities. Additionally, in prior art systems where there is a physical tie or connection between the reboiler and the condenser of the upstream column and the downstream column, it is not possible to stack multiples of the upstream column in order to process larger feed stream volumes. Such stacking is possible with system 30 because there is no energy tie between the fractionating columns in Processing Stage 103 and Processing Stage 104 as with prior art systems. Similar stacking may be used in Processing stage 103 with System 10 to process larger volumes of feed.

System 30, like System 10, also has greater flexibility because the condenser and reboiler duties for 2nd Column Node 1006 are not connected. System 30 should be able to successfully process streams where the inlet nitrogen concentration is greater than the design specification by 10% or more. Disconnecting the two thermal requirements in System 30 allows for independent control which provides for a much wider permissible range of inlet nitrogen. Having the duties linked in prior art systems may reduce the initial costs of the 2nd Column, but the operational benefits achieved with the flexibility afforded by not linking the duties in System 30 outweighs the initial cost savings associated with linking.

A preferred embodiment of Processing stage 104 is depicted in FIG. 3B. Processing stage 104 preferably comprises a 3nd Heat Exchange Node 1005, a 4th Heat Exchange Node 1007, a 5th Heat Exchange Node 1008 and a 2nd Fractionation Column Node 1006. The 2nd Fractionation Column Node 1006 is an 18 theoretical stage column in this example. The 3rd Heat Exchange Node 1005 comprises a plate-fin heat exchanger. The plate-fin exchanger provides the primary heat transfer requirements for the process. The Nitrogen ($N_2$) Preheater is a shell and tube heat exchanger located within Node 1010. This exchanger is extremely important in that it provides two important functions: (1) Thermal protection to Node 1005. The preheater will warm the nitrogen from approximately −300° F. (stream 136) to a temperature of approximately −200° F. The aluminum heat exchangers have a maximum 50° F. gradient limitation on the terminus temperatures. If the extracted nitrogen were to directly enter the aluminum heat exchanger then there would be a 100° F. terminus differential which is outside of the exchanger manufacturer tolerance limits. (2) During startup and operation of the facility, reducing the temperature of the Nitrogen Preheater cross exchange stream 127 is critical to efficient operation of the overall system. The energy required to heat the nitrogen stream from −300° F. to −200° F. is extracted from the process stream feeding into the NRU fractionation tower which indirectly reduces the amount of compression horsepower required for operation.

The 4th Heat Exchange Node 1007 preferably is comprised of a shell and tube style heat exchanger that acts as a reboiler for Column Node 1006. The reboiler (Node 1007, Q-3 in Energy Table 9) for Column Node 1006 is mounted external to the tower and is of conventional design. One advantage of this design is that the placement of this heat exchanger not only provides the necessary heat or energy for the Column Node 1006 "reboiler" but that it also reduces the temperature differential across the plate-fin exchanger in Node 1005 as discussed further below. The 5th Heat Exchange Node 1008 preferably comprises of two shell and tube type exchangers. The first is the "reflux condenser" physically mounted inside the Column Node 1006 and is known in the industry as a vertical tube, falling film style exchanger. This exchanger is preferably an internal "knock-back" condenser of the type disclosed in U.S. Patent Application Publication 2007/0180855, incorporated herein by reference. The second is an external conventional shell and tube type exchanger used to subcool the refrigerant feed stream into the reflux condenser.

As with System 10, the 1st Fractionating Column Node overhead stream 110 passes through 1st heat Exchanger Node 1000, emerging as stream 121 with a temperature of 110° F. and a pressure of near 560 psia. Stream 121 then passes through the 3rd Heat Exchanger Node and enters into Separation Node 1012 splitting into two streams with stream 123 entering back into the 3nd Heat Exchanger Node 1005 and stream 124 entering into the 4th Heat Exchanger Node 1007. The first of these streams is stream 124 at a temperature of near −75° F. and a pressure of 557 psia, which passes through 4th Heat Exchanger Node 1007 and serves as the heating medium for the Column Node 1006 reboiler. The second stream is recycled through Heat Exchanger Node 1005 where it is further cooled and then passes through a JT pressure reducing control valve (Node 1010) and exits as stream 127 at a temperature of 211° F. and a pressure of 274 psia. Stream 127 is the first of two feed streams into 2nd Fractionating Column Node 1006, entering the column at 274 psia and near −209° F. Stream 124 continues through the 4th Heat Exchanger Node 1007, enters a second JT pressure reducing valve and then exits as stream 135 with a temperature of −182° F. and a pressure of near 274 psia. Stream 135 is the second feed steam entering 2nd Fractionating Column ode 1006.

Stream 131 exits the 2nd Column Node 1006 bottom as a liquid having a temperature of near −168° F. and a pressure of 274 psia. Stream 131 then enters 4th Heat Exchanger Node 1007 (external reboiler) where it is heated and partially split into stream 132. Stream 132 reenters the Column Node 1006 as a partially vapor and partially liquid stream. Stream 132 has a temperature of −166° F. and a pressure of 274 psia. The remainder of stream 131 exits 4th Heat Exchanger Node 1007 and is split into streams 142, 143, and 144, which are the bottoms liquids streams from Column Node 1006. The composition of all three streams is the same at 0.95% nitrogen and 99.05% methane and heavier hydrocarbon. For simplicity, streams 142, 143, and 144 are depicted in FIG. 3B as exiting from 4th Heat Exchanger Node 1007 with stream 144 mixing with stream 339 before entering 5th Heat Exchanger Node 1008 and streams 142 and 143 entering 3rd Heat Exchange Node 1005.

Stream 144 is routed to the 5th Heat Exchanger Node 1008 (subcooler portion) where is subcooled to a temperature of near −245° F. before being expanded by means of a third JT expansion valve to a temperature of approximately −254° F. This stream is utilized as the refrigerant required for the reflux condenser in 5th Heat Exchange Node 1008 to operate satisfactorily. Stream 142 is a 100% liquid stream exiting the reboiler in Node 1007 from the bottom of the fractionation column and enters the 3rd Heat Exchanger Node 1005. The temperature of stream 142 is −166° F. with a pressure of near 273 psia. Stream 142 exits the exchanger Node 1005 as stream 152 where it is then routed to the compression Node 1011. Stream 143 is an intermediate pressure stream existing at a temperature of near −196° F. and a pressure of near 132 psia and exits the exchanger Node as stream 151. The purpose of this stream is to improve thermal efficiency in the plate fin exchanger located in Node 1005. The higher efficiency results in a significant reduction in compression energy required.

The reflux of the 2nd Fractionating Column Node 1006 is accomplished within the 5th Heat Exchanger Node 1008. Internal stream 128 exits the fractionation section of the column and enters the reflux condenser and is at −234° F. and 274 psia. At this point the composition is approximately 87% nitrogen, 13% methane and 100% vapor. Stream 128 is separated into a partially condensed stream 129 and vapor stream 330 (which is the overhead stream from 2nd Fractionating Column Node 1006). Stream 129 exits condenser 1008 with a temperature of approximately −246° F. and a pressure of 274 psia with a composition of 82% nitrogen and 18% methane. Stream 330 having a composition of near 95% nitrogen and 5% methane is then routed to the 8th Heat Exchanger Node 3000 in Processing Stage 300 to remove the excess hydrocarbons. The condenser (Node 1008) and reboiler (node 1007) duties for 2nd Column Node 1006 are not connected, allowing for greater flexibility in System 30.

Referring to FIG. 3C, methane enriched streams 350, 120, 151, and 152 all feed into compressor Node 1011, where they pass through compression stages. As the lowest pressure stream, stream 350 enters Node 1011 first, emerging as stream 367 at a pressure and temperature suitable for pipeline transportation. Within the interstages of Node 1011, additional side streams 120, 151, and 152 are introduced and combined with the upstream streams as indicated on FIG. 3C where interstage pressures are ideal. Stream 122, which is already at approximately 1060 psia, is combined with stream 367 downstream of Compressor Node 1011 to form a final product sales stream 385. Compression will be further understood by those of ordinary skill in the art.

Stream 330 exits the 2nd Frac Column Node 1006 as the overhead stream (actually exiting from the condenser portion of 5th Heat Exchanger Node 1008) with a temperature of near −246° F. and a pressure of 274 psia. The composition of stream 330 is approximately 95% nitrogen and 5% methane. Because this amount of methane is generally too high to vent with a nitrogen vent stream, the 2nd Fractionating Column Node overhead stream 330 is processed through Processing stage 300.

Referring to FIG. 3D, Processing Stage 300 preferably comprises a 8th Heat Exchanger Node 3000 and a 3rd Fractionating Column node 3001. 8th Heat Exchanger Node 3000 preferably comprises a plate fin exchanger to cool the feed stream prior to entering 3rd Fractionating Column node 3001. Stream 330 enters the plate fin portion of the 8th Heat Exchanger Node 3000 then passes through a 4th JT pressure reducing valve exiting as stream 356. The temperature of stream 356 is approximately −305° F. and has a pressure of 35 psia. This stream is the feed to the 3rd Fractionating Column Node 3001 where the methane and nitrogen are further separated. Stream 359 exits as the overhead stream from Node 3001 and reenters plate fin portion of the 8th Heat Exchanger Node 3000 in a 100% vapor state. Stream 359 exits the exchanger Node 3000 as stream 338 where it then enters the 3rd Heat Exchanger Node 1005 of Processing Stage 104 at a temperature of approximately −275° F. and a pressure of 23 psia. This stream then exits Node 1005 as nitrogen vent stream 355 with a temperature of 100° F. and atmospheric pressure. The composition of stream 355 is approximately 99.64% nitrogen and 0.36% methane. The ultra low methane content in stream 355 represents a significantly lower methane emission than is available from other known prior art technologies.

The condensed liquid in the Column Node 3001 is then routed into the reboiler portion of the 9th Heat Exchanger Node 3002 as stream 358 where heat is absorbed as required to produce the nitrogen purity. After heat is added to stream 358 it exits the heat exchanger as stream 360 and re-enters the 3rd Frac Column Node 3001. The heat source for exchanger Node 3000 comes from the inlet stream 330 and is designed to be a separate pass in the heat exchanger Node 3000 (not shown). The recovered methane with a purity of approximately 90% exits the Column Node 3001 (from the reboiler portion of the 9th Heat Exchange Node 3002 as the bottoms stream 339 and is then routed to the 5th heat exchanger Node 1008 where it is added to stream 144 after being subcooled and passing through a JT valve as described above. The combined stream then passes through the condenser portion and back through the subcooler portion of 5th Heat Exchanger Node 1008, exiting as stream 349 at a temperature of −190° F. and a pressure of 16.4 psia. Stream 349 then enters the 3rd Heat Exchanger Node 1005, exiting as stream 350 warmed to near 73° F.

The flow rates, temperatures and pressures of various flow streams referred to in connection with the discussion of the system and method of the invention in relation to FIGS. 3A, 3B, 3C, and 3D are based on a computer simulation for System 30 having a 250 MMSCFD feed stream 101 containing approximately 25% nitrogen and 70% methane at 115° F. and 865 psia and appear in Table 8 below. The values for the energy streams referred to in connection with the discussions of the system and method of the invention in relation to FIGS. 3, 3A, 3B, 3C and 3D appear in Table 9 below. The temperatures, pressures, flow rates, and compositions will vary depending on the nature of the feed stream 101 and other operational parameters as will be understood by those of ordinary skill in the art.

TABLE 8

FLOW STREAM PROPERTIES

| Stream Reference Numeral | % N2 | % CH4 | Molar Flow (lbmol/h) | Std Vapor Volumetric Flow (MMSCFD) | Temperature (° F.) | Pressure (psia) |
|---|---|---|---|---|---|---|
| 101 | 25.0 | 70.0 | 26164 | 250 | 115 | 865 |
| 102 | 25.0 | 70.0 | 26164 | 250 | −75 | 860 |
| 106 | 25.0 | 70.0 | 14865 | 142 | −75 | 860 |
| 107 | 25.0 | 70.0 | 11299 | 108 | −75 | 860 |
| 109 | 25.0 | 70.0 | 11299 | 108 | −186 | 564 |
| 110 | 38.8 | 60.9 | 16628 | 159 | −156 | 564 |
| 111 | 2.0 | 90.3 | 17959 | 172 | −123 | 569 |
| 112 | 3.2 | 95.3 | 8423 | 80 | −117 | 569 |
| 114 | 1.0 | 85.8 | 3814 | 36 | −117 | 569 |
| 116 | 1.0 | 85.8 | 5722 | 55 | −189 | 125 |
| 117 | 1.0 | 85.8 | 3814 | 36 | −108 | 1065 |
| 119 | 25.0 | 70.0 | 14865 | 142 | −127 | 720 |
| 120 | 1.0 | 85.8 | 5722 | 55 | 75 | 120 |
| 121 | 38.8 | 60.9 | 16628 | 159 | 110 | 559 |
| 122 | 1.0 | 85.8 | 3814 | 36 | 110 | 1060 |
| 123 | 38.8 | 60.9 | 16628 | 159 | −75 | 557 |
| 124 | 38.8 | 60.9 | 9504 | 91 | −75 | 557 |
| 125 | 38.8 | 60.9 | 7124 | 68 | −75 | 557 |
| 126 | 38.8 | 60.9 | 5703 | 54 | −180 | 556 |

TABLE 8-continued

FLOW STREAM PROPERTIES

| Stream Reference Numeral | % N2 | % CH4 | Molar Flow (Ibmol/h) | Std Vapor Volumetric Flow (MMSCFD) | Temperature (° F.) | Pressure (psia) |
|---|---|---|---|---|---|---|
| 127 | 38.8 | 60.9 | 7124 | 68 | −209 | 349 |
| 128 | 87.1 | 12.9 | 16606 | 159 | −234 | 274 |
| 129 | 81.8 | 18.2 | 9920 | 95 | −246 | 274 |
| 131 | 2.0 | 97.7 | 15064 | 144 | −168 | 274 |
| 132 | 4.0 | 95.9 | 5121 | 49 | −166 | 274 |
| 135 | 38.8 | 60.9 | 9504 | 91 | −182 | 349 |
| 142 | 0.9 | 98.5 | 994 | 9 | −166 | 273 |
| 143 | 0.9 | 98.5 | 2553 | 24 | −196 | 132 |
| 144 | 0.9 | 98.5 | 6395 | 61 | −166 | 274 |
| 147 | 0.9 | 98.5 | 6395 | 61 | −254 | 20 |
| 148 | 0.9 | 98.5 | 7763 | 74 | −255 | 17 |
| 349 | 1.1 | 98.4 | 6722 | 64 | −190 | 16 |
| 151 | 0.9 | 98.5 | 2553 | 24 | 100 | 128 |
| 152 | 0.9 | 98.5 | 994 | 9 | 100 | 271 |
| 330 | 95.0 | 5.0 | 6685 | 64 | −246 | 274 |
| 338 | 99.6 | 0.4 | 6358 | 61 | −275 | 23 |
| 337 | 99.6 | 0.4 | 6358 | 61 | −185 | 18 |
| 339 | 5.0 | 95.0 | 327 | 3 | −265 | 20 |
| 350 | 1.0 | 92.3 | 6722 | 64 | 73 | 15 |
| 355 | 100 | 0.4 | 6358 | 61 | 100 | 13 |
| 356 | 95.0 | 5.0 | 6685 | 64 | −305 | 35 |
| 358 | 48.9 | 51.1 | 4654 | 44 | −296 | 36 |
| 359 | 99.6 | 0.4 | 6358 | 61 | −307 | 25 |
| 360 | 52.3 | 47.7 | 4327 | 41 | −255 | 36 |
| 367 | 1.1 | 93.9 | 15991 | 153 | 120 | 1050 |
| 385 | 1.0 | 92.3 | 19806 | 189 | 118 | 1050 |

TABLE 9

ENERGY STREAM REPORT

| Energy Stream | Energy Rate | Power | From Block | To Block |
|---|---|---|---|---|
| Q-1 | 0.39 MMBtu/h | 114.076 kW | — | LNG Pump |
| Q-2 | 14.10 MMBtu/h | 4131.16 kW | 1st Ht Ex Node 1000 | 2nd HT Ex Node 1004 |
| Q-3 | 12.76 MMBtu/h | 3738.43 kW | 4th Ht Ex Node 1007 | 4th Ht Ex Node 1007 |
| Q-4 | 0.39 MMBtu/h | 114.076 kW | 2nd Frac Column Node 1006 | 5th Ht Ex Node 1008 |
| Q-5 | 13.84 MMBtu/h | 4056.19 kW | 3rd Frac Column Node 3001 | 6th Ht Ex Node 3000 |

The source of NRU feed gas 101 or 201 is not critical to the systems and methods of the invention; however, natural gas drilling and processing sites with flow rates of 50 MMSCFD or greater are particularly suitable. The NRU feed gas 101 or 201 used as the inlet gas stream for Systems 10, 20, or 30 will typically contain a substantial amount of nitrogen and methane, as well as other hydrocarbons, such as ethane and propane, and may contain other contaminants, such as water vapor and carbon dioxide. Where present, it is generally preferable for purposes of the present invention to remove as much of the water vapor and other contaminants from the NRU feed gas 101 or 201 as is reasonably possible prior to separating the nitrogen and methane. It may also be desirable to remove excess amounts of carbon dioxide prior to separating the nitrogen and methane; however, the method and system are capable of processing NRU feed streams containing up to around 100 ppm carbon dioxide without encountering the freeze-out problems associated with prior systems and methods. Methods for removing water vapor, carbon dioxide, and other contaminants are generally known to those of ordinary skill in the art and are not described herein.

The specific operating parameters described herein as based on the specific computer modeling and feed stream parameters set forth above. These parameters and the various composition, pressure, and temperature values described above will vary depending on the feed stream parameters as will be understood by those of ordinary skill in the art. Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A system for removing nitrogen and for producing a methane product stream from a first feed stream comprising nitrogen and methane, the system comprising:

a first splitter wherein the first feed stream is divided into a second feed stream and a third feed stream;

a first fractionating column wherein the second feed stream and the third feed stream are separated into a first overhead stream and a first bottoms stream;

a second fractionating column comprising a condenser and a second external reboiler, wherein the first overhead stream is separated into a second overhead stream and a second bottoms stream;

a third fractionating column wherein the second overhead stream is separated into a third overhead stream and a third bottoms stream;

a first heat exchanger for cooling the first feed stream upstream of the first splitter and for cooling the second feed stream upstream of the first fractionating column through heat exchange with the first bottoms stream and the first overhead stream, whereby the first bottoms stream and first overhead stream are heated in the first heat exchanger;

a first external reboiler for cooling the third feed stream upstream of the first fractionating column through heat exchange with the first bottoms stream upstream of the first bottoms stream passing through the first heat exchanger;

a second heat exchanger for cooling the first overhead stream upstream of the second fractionating column through heat exchange with the second bottoms stream, the third bottoms stream, and the third overhead stream, whereby the second bottoms stream, the third bottoms stream, and the third overhead stream are heated in the second heat exchanger;

wherein the methane product stream comprises the first bottoms stream, the second bottoms stream, and the third bottoms stream; and wherein the third overhead stream is a nitrogen vent stream.

2. The system of claim 1 wherein the third feed stream is fed into the first fractionating column at a third feed stream tray location and the second feed stream is fed into the first fractionating column at a second feed stream tray location and wherein the third feed stream tray location is below the second feed stream tray location.

3. The system of claim 1 further comprising a second splitter downstream of the second heat exchanger for dividing the first overhead stream into a fourth feed stream and a fifth feed stream upstream of the second fractionating column and wherein the fourth feed stream is cooled upstream of the second fractionating column in the second heat exchanger and wherein the fifth feed stream is cooled upstream of the second fractionating column in the second external reboiler.

4. The system of claim 3 wherein the fourth feed stream is fed into the second fractionating column at a fourth feed stream tray location and the fifth feed stream is fed into the second fractionating column at a fifth feed stream tray location, and wherein the fifth feed stream tray location is below the fourth feed stream tray location.

5. The system of claim 3 further comprising a third splitter for dividing the first bottoms stream into a first part and a second part upstream of the first heat exchanger;

a pump for pumping the second part to increase a pressure of the second part; and wherein the first and second parts pass through the first heat exchanger.

6. The system of claim 5 further comprising a fourth splitter for dividing the second bottoms stream into at least two parts, wherein one of those parts is a refrigerant stream;

a mixer for mixing the third bottoms stream and refrigerant stream to produce a mixed stream that passes through the condenser in the second fractionating column prior to passing through the second heat exchanger.

7. The system of claim 6 further comprising a subcooler, wherein the refrigerant stream passes through the subcooler prior to mixing with the third bottoms stream and wherein the mixed stream passes through the subcooler after passing through the condenser and upstream of the second heat exchanger.

8. The system of claim 7 further comprising a third heat exchanger for cooling the second overhead stream upstream of the third fractionating column through heat exchange with the third overhead stream, whereby the third overhead stream is heated in the third heat exchanger upstream of the second heat exchanger.

9. A method for removing nitrogen and for producing a methane product stream, the method comprising the steps of:

providing a first feed stream comprising nitrogen and methane;

dividing the first feed stream into a second feed stream and a third feed stream in a first splitter;

feeding the second feed stream and third feed stream into a first fractionating column;

separating the second feed stream and the third feed stream in the first fractionating column into a first overhead stream and a first bottoms stream;

cooling the third feed stream upstream of the first fractionating column through heat exchange with the first bottoms stream in a first reboiler external to the first fractionating column;

feeding the first overhead stream into a second fractionating column comprising a condenser and a second external reboiler;

separating the first overhead stream in the second fractionating column into a second overhead stream and a second bottoms stream;

feeding the second overhead stream into a third fractionating column;

separating the second overhead stream in the third fractionating column into a third overhead stream and a third bottoms stream;

cooling the first feed stream upstream of the first splitter and cooling the second feed stream upstream of the first fractionating column in a first heat exchanger through heat exchange with the first bottoms stream and the first overhead stream, whereby the first bottoms stream and first overhead stream are heated in the first heat exchanger;

cooling the first overhead stream upstream of the second fractionating column in a second heat exchanger through heat exchange with the second bottoms stream, the third bottoms stream, and the third overhead stream, whereby the second bottoms stream, the third bottoms stream, and the third overhead stream are heated in the second heat exchanger;

wherein the methane product stream comprises the first bottoms stream, second bottoms stream, and third bottoms stream; and wherein the third overhead stream is a nitrogen vent stream.

10. The method of claim 9 further comprising feeding the third feed stream into the first fractionating column at a first tray location below a second tray location for feeding the second feed stream into the first fractionating column.

11. The method of claim 9 further comprising dividing the first overhead stream into a fourth feed stream and a fifth feed stream in a second splitter upstream of the second fractionating column and downstream of the second heat exchanger; and feeding the fifth feed stream into the second fractionating column at a third tray location below a fourth tray location for feeding the fourth feed stream into the second fractionating column.

12. The method of claim 9 further comprising dividing the first overhead stream into a fourth feed stream and a fifth feed stream in a second splitter downstream of the second heat exchanger and upstream of the second fractionating column;

cooling the fourth feed stream upstream of the second fractionating column in the second heat exchanger;

cooling the fifth feed stream upstream of the second fractionating column in the second external reboiler.

13. The method of claim 12 further comprising feeding the fifth feed stream into the second fractionating column at a third tray location below a fourth tray location for feeding the fourth feed stream into the second fractionating column.

14. The method of claim 12 further comprising dividing the first bottoms stream into a first part and a second part in a third splitter upstream of the first heat exchanger;

pumping the second part to increase a pressure of the second part; and warming the first and second parts in the first heat exchanger.

15. The method of claim 14 further comprising dividing the second bottoms stream into at least two parts in a fourth splitter, wherein one of those parts is a refrigerant stream;

mixing the third bottoms stream and refrigerant stream to produce a mixed stream; and passing the mixed stream through the condenser in the second fractionating column upstream of passing the mixed stream through the second heat exchanger.

16. The method of claim 15 further comprising passing the refrigerant stream through a subcooler prior to mixing with the third bottoms stream; and passing the mixed stream through the subcooler downstream of the condenser and upstream of the second heat exchanger.

17. The method of claim 16 further comprising cooling the second overhead stream upstream of the third fractionating column in a third heat exchanger through heat exchange with the third overhead stream, whereby the third overhead stream is heated in the third heat exchanger upstream of mixing with the refrigerant stream.

* * * * *